US008454154B2

(12) United States Patent
Yoshida et al.

(10) Patent No.: US 8,454,154 B2
(45) Date of Patent: Jun. 4, 2013

(54) INK JET RECORDING DEVICE AND METHOD OF CONVEYING RECORDING MEDIUM IN THE SAME

(75) Inventors: Yasunari Yoshida, Aichi-ken (JP); Masahiko Sasa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/419,192

(22) Filed: Mar. 13, 2012

(65) Prior Publication Data

US 2012/0169818 A1 Jul. 5, 2012

Related U.S. Application Data

(63) Continuation of application No. 11/700,146, filed on Jan. 31, 2007, now Pat. No. 8,157,368.

(30) Foreign Application Priority Data

Jan. 31, 2006 (JP) ..... 2006-022110
Jan. 31, 2006 (JP) ..... 2006-022553

(51) Int. Cl.
*B41J 2/01* (2006.01)
*B41J 11/14* (2006.01)

(52) U.S. Cl.
USPC ..... 347/104; 347/101

(58) Field of Classification Search
USPC ..... 347/101, 104
See application file for complete search history.

(56) References Cited

U.S. PATENT DOCUMENTS 6,239,817 B1 5/2001 Meyer
6,352,381 B1 3/2002 Gonmori et al.
6,471,351 B1 10/2002 Ishikawa et al.
6,659,603 B2 12/2003 Kida et al.
6,964,466 B1 11/2005 Kodama et al.
7,585,042 B2 * 9/2009 Otsuki ..... 347/19

(Continued)

FOREIGN PATENT DOCUMENTS

JP 2000-118058 A 4/2000
JP 2000-118059 A 4/2000

(Continued)

OTHER PUBLICATIONS

Japan Patent Office, Office Action for Japanese Patent Application No. 2006-022553 (counterpart to co-pending U.S. Appl. No. 11/700,146), mailed Jan. 25, 2011.

(Continued)

*Primary Examiner* — Matthew Luu
*Assistant Examiner* — Rut Patel
(74) *Attorney, Agent, or Firm* — Baker Botts L.L.P.

(57) ABSTRACT

An ink jet recording device includes a recording head, a conveying member, a platen, a supporting member, and a driving member. The recording head ejects ink droplets onto a recording medium. The conveying member conveys the recording medium in a conveying direction. The recording medium has a leading edge and a trailing edge in the conveying direction. The platen is disposed in confrontation with the recording head to support the recording medium while keeping a predetermined distance from the recording head. The supporting member is disposed in the platen to slide in the conveying direction while supporting the recording medium. The driving member drives the supporting member to start sliding in the conveying direction at a starting timing corresponding to a position of at least one of the leading edge and the trailing edge.

11 Claims, 22 Drawing Sheets

U.S. PATENT DOCUMENTS

| | | | |
|---|---|---|---|
| 7,588,300 | B2 | 9/2009 | Koga et al. |
| 7,673,985 | B2 | 3/2010 | Sasa |
| 7,717,634 | B1 | 5/2010 | Budelsky et al. |
| 7,722,182 | B2 | 5/2010 | Sasa |
| 7,942,519 | B2 | 5/2011 | Takeuchi |
| 2002/0154203 | A1 | 10/2002 | Tanaka |
| 2002/0191064 | A1 | 12/2002 | Ishikawa et al. |
| 2004/0046829 | A1 | 3/2004 | Taguchi et al. |
| 2005/0122384 | A1 | 6/2005 | Kodama et al. |
| 2007/0165092 | A1 | 7/2007 | Kito |
| 2010/0026772 | A1 | 2/2010 | Miyata |

FOREIGN PATENT DOCUMENTS

| | | | |
|---|---|---|---|
| JP | 2000-351205 | A | 12/2000 |
| JP | 2001-080145 | A | 3/2001 |
| JP | 2002-307769 | A | 10/2002 |
| JP | 2004-114680 | A | 4/2004 |
| JP | 2007-190746 | A | 8/2007 |

OTHER PUBLICATIONS

Japan Patent Office, Office Action for Japanese Patent Application No. 2006-022110 (counterpart to co-pending U.S. Appl. No. 11/700,146), mailed Feb. 1, 2011.

Japan Patent Office, Decision of Rejection for Japanese Patent Application No. 2006-022553 (counterpart to co-pending U.S. Appl. No. 11/700,146), mailed Oct. 4, 2011.

* cited by examiner

INK JET RECORDING DEVICE AND METHOD OF CONVEYING RECORDING MEDIUM IN THE SAME

CROSS-REFERENCE TO RELATED APPLICATIONS

The present application is a continuation application of U.S. patent application Ser. No. 11/700,146, which was filed on Jan. 31, 2007, and claims the benefit of Japanese Patent Application Nos. 2006-022553 and 2006-022110, both of which were filed on Jan. 31, 2006. The disclosures of those patent applications are incorporated herein by reference in their entirety.

BACKGROUND OF THE INVENTION

1. Field of the Invention

The present invention relates to an ink jet recording device.

2. Description of Related Art

An ink jet recording device has a recording head in which a lot of nozzles axe arrayed. A recording medium (typically, recording sheet) on which an image is recorded is conveyed below the recording head. The recording head ejects ink drops from the nozzles at a predetermined timing while moving in a main scanning direction (a direction orthogonal to a recording sheet conveyance direction), thereby recording the image on the recording sheet. In recent years, the ink jet recording device has a function of recording the image on the recording sheet without forming a blank space in the border of the recording sheet as in photo printing. Thus, such image recording is called as "borderless recording".

In the borderless recording, when an image is recorded, ink is ejected to the outside of the recording sheet beyond the border of the recording sheet as well as the recording sheet. For example, in the borderless recording at the front end and the rear end of the recording sheet, the recording sheet is positioned relative to the recording head so that some nozzles of the lot of nozzles may be located outside of the border of the recording sheet and eject ink drops on a platen disposed under the recording sheet. A groove extending in the main scanning direction is provided on an upper surface of the platen. The groove has an ink absorption therein. Thus, ink drops which are not adhered to the recording sheet are adsorbed in the ink absorption material. In Unexamined Patent Application Publication No. 2000-118058, in this manner, the image is recorded all over the recording sheet without forming a blank space in the border of the recording sheet and furthermore, a back surface of the recording sheet is prevented from being smeared with the ink ejected on the platen.

In these years, speeding-up of image recording by the ink jet recording device has been requested. To achieve speeding-up of image recording, upsizing of the recording head has been conventionally attempted. As the recording head is upsized, the number of nozzles aligned in the recording sheet conveyance direction is increased, thereby enabling high-speed recording. However, to perform the above-mentioned borderless recording satisfactorily, as the recording head is upsized, the width dimension (dimension in the recording sheet conveyance direction) of the groove formed on the platen need to be made larger.

When the above-mentioned borderless recording is performed, the recording sheet is disposed on the groove formed on the platen. Thus, when the width of the groove in the recording sheet conveyance direction is increased, the recording sheet is bent downward in the vertical direction and deformed to fall into the groove. When the recording sheet is bent, a distance between the nozzles of the recording head and the surface of the recording sheet is changed, thereby possibly causing defective recording.

In Unexamined Patent Application Publications No. 2001-80145 and No. 2002-307769, to eliminate such disadvantages, a sheet support member is provided in the groove on the platen so as to rotate in connection with conveyance of the recording sheet. Thus, the sheet support member supports the recording sheet advancing on the groove and a region of the sheet support member which supports the recording sheet moves in the groove width direction. Accordingly, even when the recording sheet is conveyed above the groove on the platen, the recording sheet is supported by the sheet support member.

SUMMARY OF THE INVENTION

However, since the sheet support member disclosed in Unexamined Patent Application Publication No. 2001-80145 is rotated around a predetermined rotational center axis, a front end of the sheet support member (a part which contacts against the recording sheet) comes closer to the recording head and then, is separated. For this reason, the recording sheet is not always supported in parallel to the recording head.

To solve this problem, a sufficient rotational radius only needs to be assured. However, this causes a new problem that the ink jet recording device is upsized. Further, a surface of the sheet support member disclosed in Unexamined Patent Application Publication No. 2001-80145 is formed in the shape of an arc extending about the rotational center axis. In this case, a point at the recording sheet is supported is fixed and thus, the end of the conveyed recording sheet is not necessarily supported at all times. That is, when the surface which supports the recording sheet is formed in the shape of an arc, the recording sheet is supported only at the above-mentioned support point and regions other than the support point (regions in front of and in the rear of the support point) are bent. As a result, as mentioned above, defective recording may occur.

Furthermore, the sheet support member disclosed in Unexamined Patent Application Publication No. 2001-80145 needs to be rotated at any time in connection with conveyance of the recording sheet. In addition, to hold the conveyed recording sheet on the groove in a flatter state, the sheet support member needs to swing at all times in the forward and reverse directions of conveyance of the recording sheet. Accordingly, since a motor for driving the sheet support member needs to rotate in the normal and reverse directions, electric power consumption of the ink jet recording device is disadvantageously increased.

In view of the above-described drawbacks, it is an objective of the present invention to provide an ink jet recording device capable of performing high-speed borderless recording by supporting the end of the conveyed recording sheet on the platen at all times.

Another object of the present invention is to provide a compact power-saving ink jet recording device capable of performing satisfactory borderless recording.

In order to attain the above and other objects, the present invention provides an ink jet recording device including a recording head, a conveying member, a platen, a supporting member, and a driving member. The recording head ejects ink droplets onto a recording medium. The conveying member conveys the recording medium in a conveying direction. The recording medium has a leading edge and a trailing edge in the conveying direction. The platen is disposed in confrontation with the recording head to support the recording medium while keeping a predetermined distance from the recording head. The supporting member is disposed in the platen to slide in the conveying direction while supporting the recording medium. The driving member drives the supporting member to start sliding in the conveying direction at a starting timing corresponding to a position of at least one of the leading edge and the trailing edge.

Another aspect of the present invention provides a method of conveying a recording medium in an ink jet recording device. The ink jet recording device includes a recording head, conveying member, a platen, and a supporting member. The recording head ejects ink droplets onto a recording medium. The conveying member conveys the recording medium in a conveying direction. The recording medium has a leading edge and a trailing edge in the conveying direction. The platen is disposed in confrontation with the recording head to support the recording medium while keeping a predetermined distance from the recording head. The supporting member is disposed in the platen to slide in the conveying direction while supporting the recording medium. The platen has a printing region over which the recording head can eject ink droplets. The supporting member slides in printing region. The method includes (a) conveying the recording medium; and (b) driving the supporting member to start sliding in the conveying direction after the leading edge of the recording medium starts sliding in the printing region.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
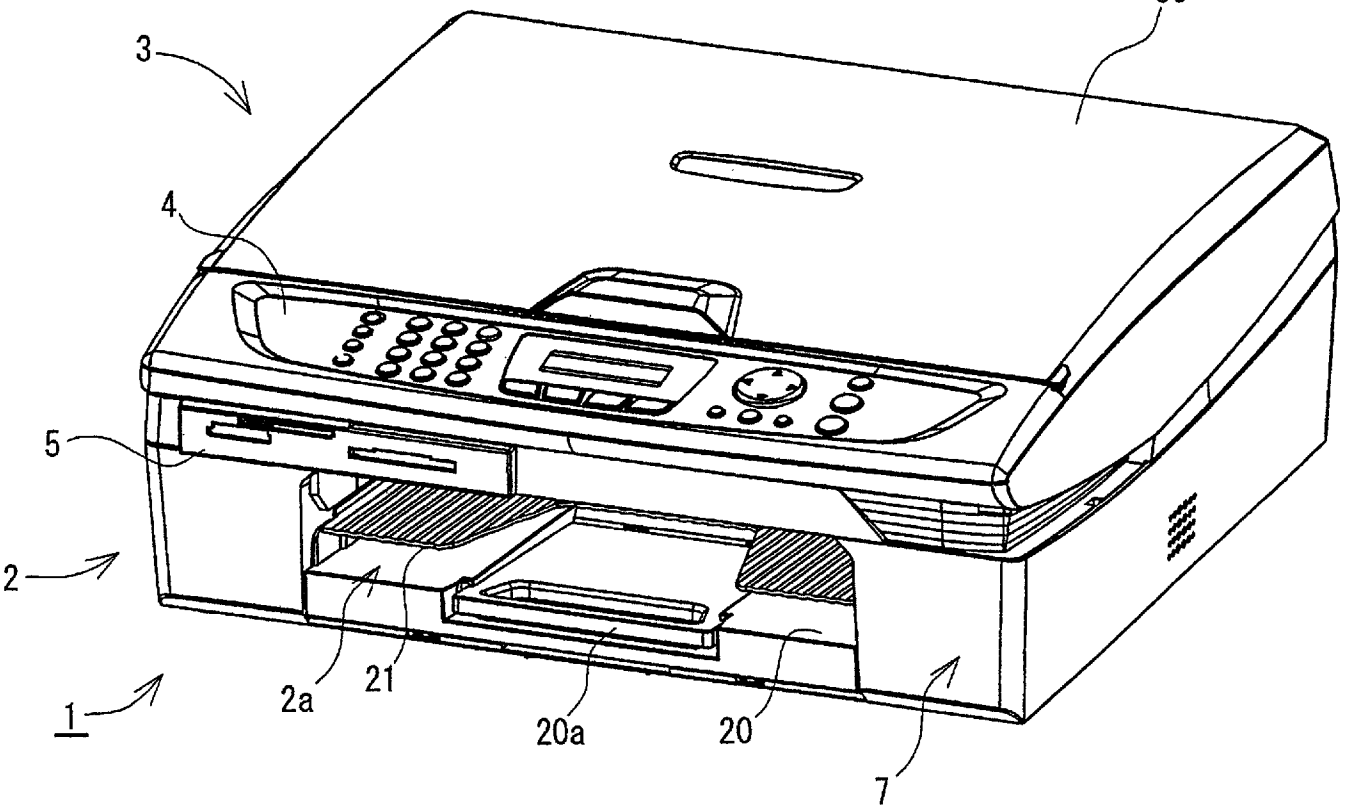
FIG. 1 is an outline perspective view of a compound machine 1 in accordance with a first embodiment of the present invention.

An ink jet recording device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the ink jet recording device is disposed in an orientation in which it is intended to be used.

Figure 2:
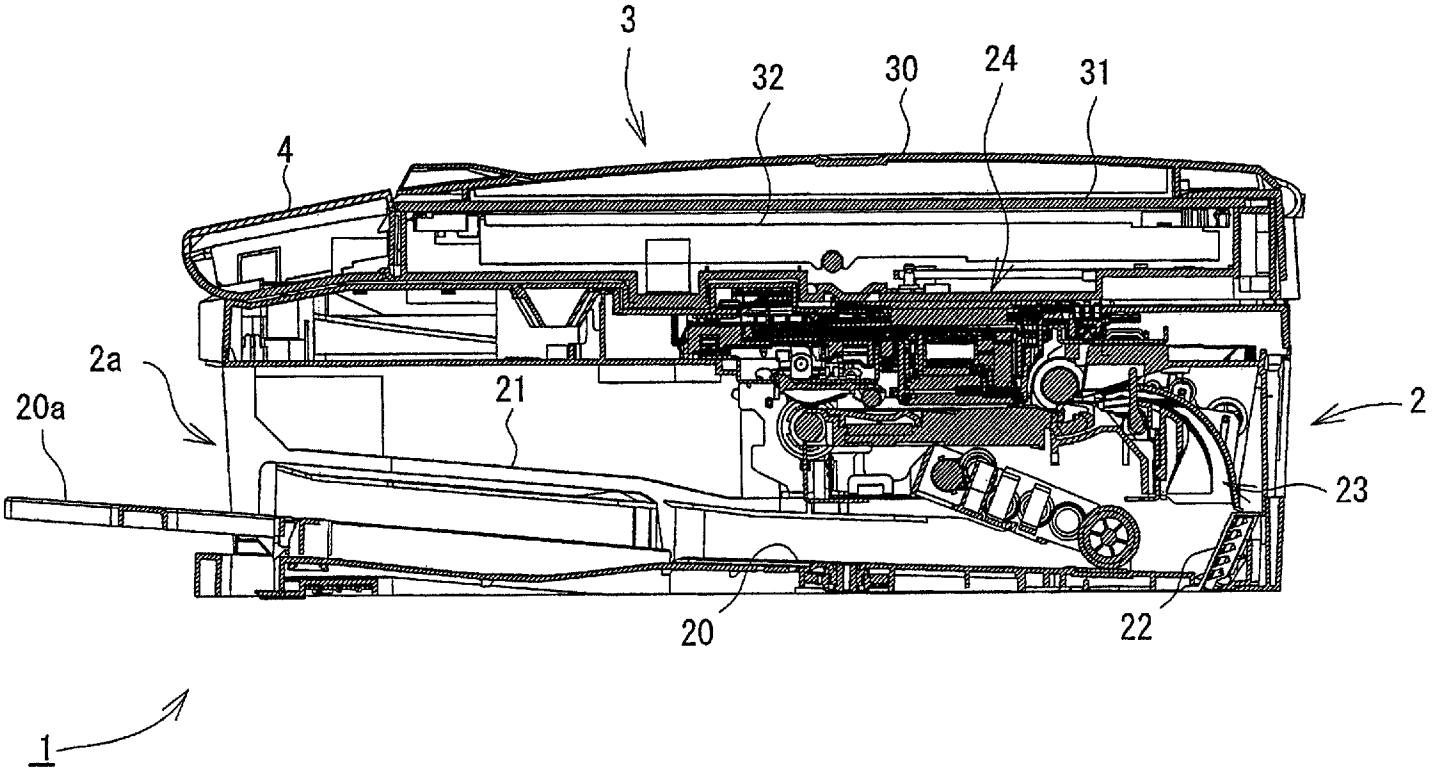
FIG. 2 is a sectional view of the compound machine 1 in accordance with the first embodiment of the present invention.

FIG. 1 is an outline perspective view of a compound machine 1 (ink jet recording device) in accordance with a first embodiment of the present invention and FIG. 2 is a sectional view of the compound machine 1.

The compound machine 1 is a multi function product (MFP) which is provided with a printer unit 2 in an upper portion thereof and a scanner unit 3 in a lower portion thereof in an integral manner and has printing, scanning, copying and faxing functions.

As shown in FIG. 1, an opening 2*a* is formed on a front surface of the printer unit 2. A sheet feed tray 20 and a sheet discharge tray 21 are provided inner of the opening 2*a* in two vertical stages. The sheet feed tray 20 has a slide tray 20*a*. By pulling out the slide tray 20*a*, the tray surface is enlarged (refer to FIG. 2).

The scanner unit 3 is provided in the upper portion of the compound machine 1. As shown in FIG. 1 and FIG. 2, a platen glass 31 and an image sensor 32 are provided below a manuscript cover 30 which is openably formed as a top board of the compound machine 1. A manuscript, an image of which is read, is mounted on the platen glass 31. The depth direction of the compound machine 1 (crosswise direction in FIG. 2) is defined as the main scanning direction. The image sensor 32 is provided below the platen glass 31 so as to reciprocate in the width direction of the compound machine 1 (direction perpendicular to the sheet of FIG. 2).

As shown in FIG. 1 and FIG. 2, an operation panel 4 operating the printer unit 2 and the scanner unit 3 is provided on the upper end of the front surface of the compound machine 1 is provided. A slot unit 5 is provided in a left upper portion of the front surface of the compound machine 1 (refer to FIG. 1).

Hereinafter, internal configuration of the compound machine 1, especially, configuration of the printer unit 2 will be described.

As shown in FIG. 2, the sheet feed tray 20 is provided on the bottom of the compound machine 1 and a separation inclined plate 22 is provided in the back of the sheet feed tray 20. A sheet conveyance path 23 extends upward from the separation inclined plate 22, turns to the front surface side, extends from the back surface to the front surface of the compound machine 1 and leads to the sheet discharge tray 21 through an image recording unit 24.

Figure 3:
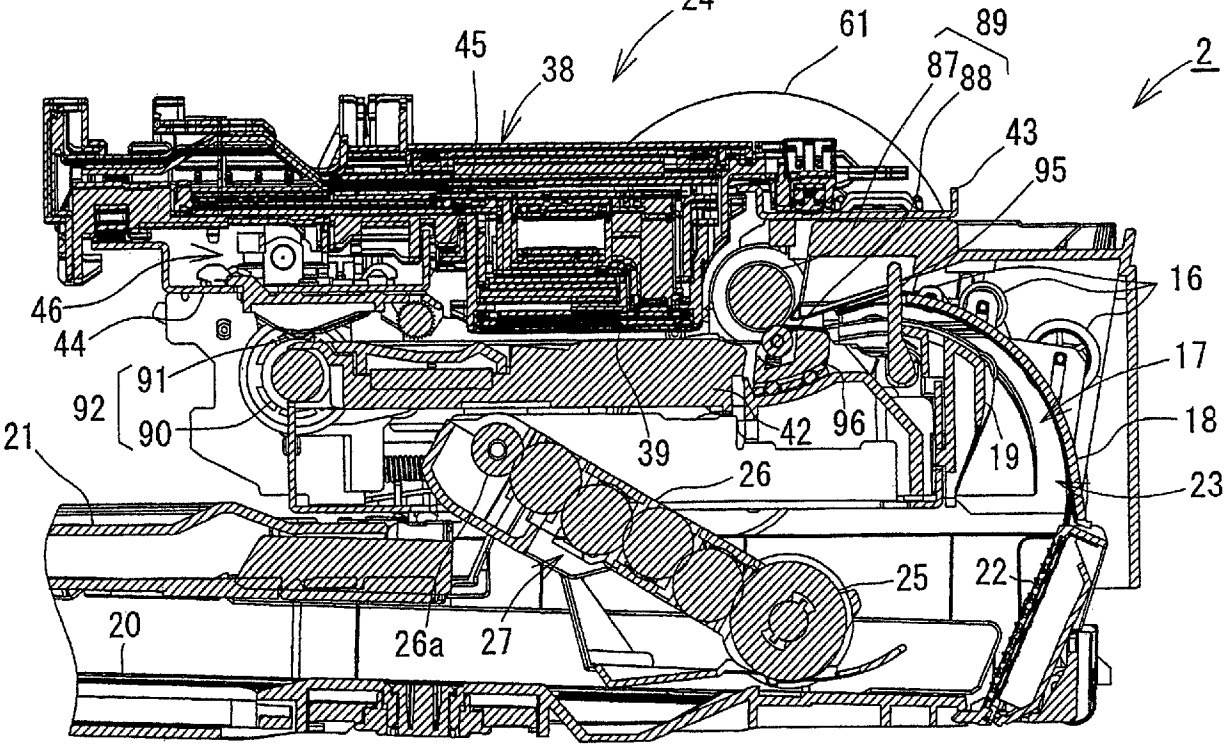
FIG. 3 is a partial enlarged sectional view showing main configuration of a printer unit 2 of the compound machine 1 in accordance with the first embodiment of the present invention.

FIG. 3 is a partial enlarged sectional view showing main configuration of the printer unit 2. As shown in FIG. 3, a sheet feed tray 25 is provided above the sheet feed tray 20. The sheet feed tray 25 is axially supported at a front end of a sheet feed arm 26. The sheet feed tray 25 is rotationally driven by an LF motor 71 as a drive source (refer to FIG. 5) via a drive transmission mechanism 27. The sheet feed arm 26 is supported by the base shaft 26*a*.

A curved part 17 of the sheet conveyance path 23 on the back surface side of the compound machine 1 is formed by fixing an outer guide member 18 and an inner guide member 19 to a frame. Rotational rollers 16 are provided at curved places on the sheet conveyance path 23.

As shown in FIG. 3, the image recording unit 24 is disposed on the sheet conveyance path 23. The image recording unit 24 has a carriage 38 which mounts an ink jet recording head 39 thereon and reciprocates in the main scanning direction. Ink of colors of cyan (C), magenta (M), yellow (Y) and black (Bk) is supplied to the ink jet recording head 39 from ink cartridges which is disposed in the compound machine 1 independently from the ink jet recording head 39 through ink tubes 41 (refer to FIG. 4).

Figure 4:
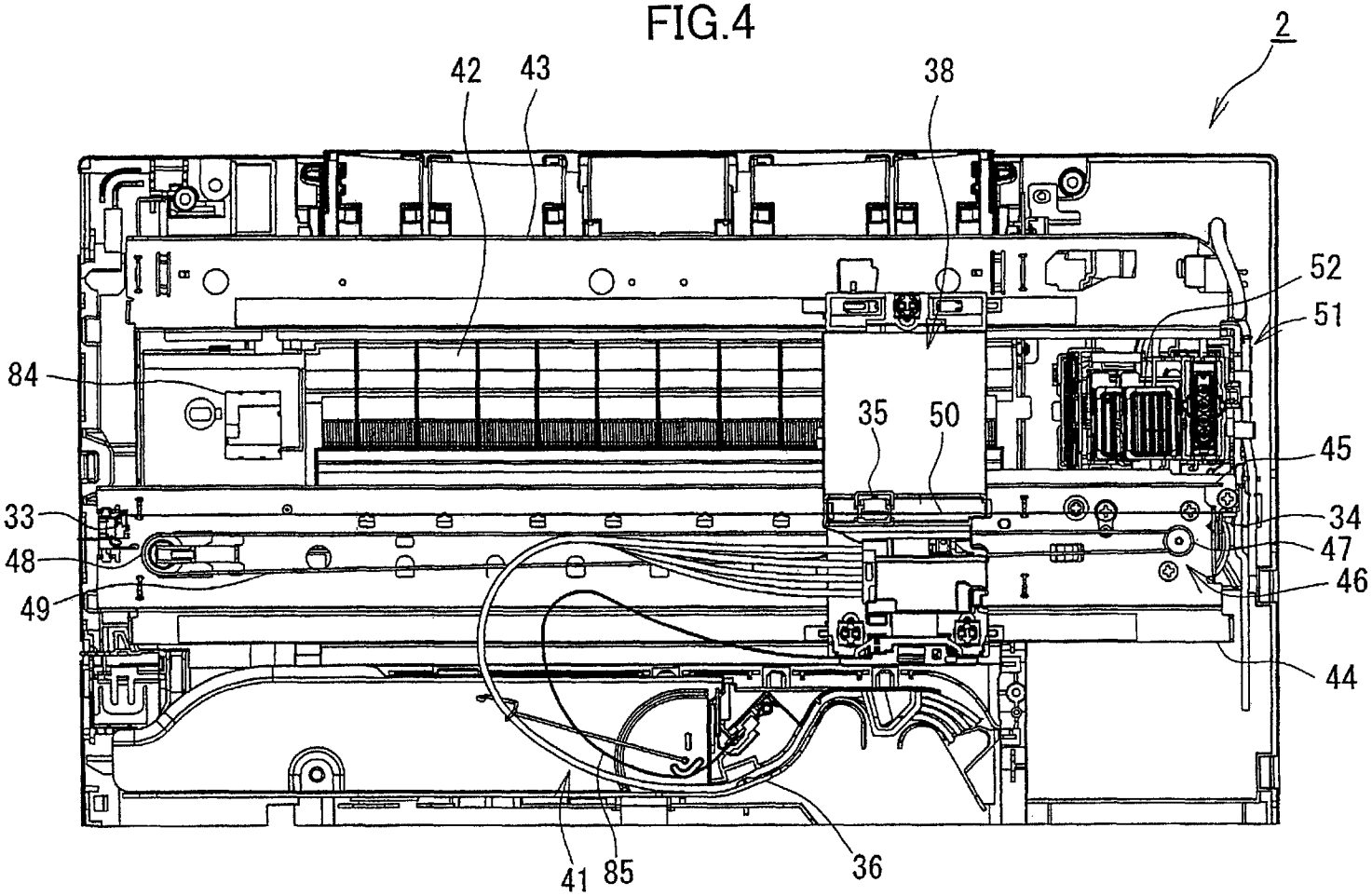
FIG. 4 is a plan view of the printer unit 2 of the compound machine 1 in accordance with the first embodiment of the present invention.
Figure 5:
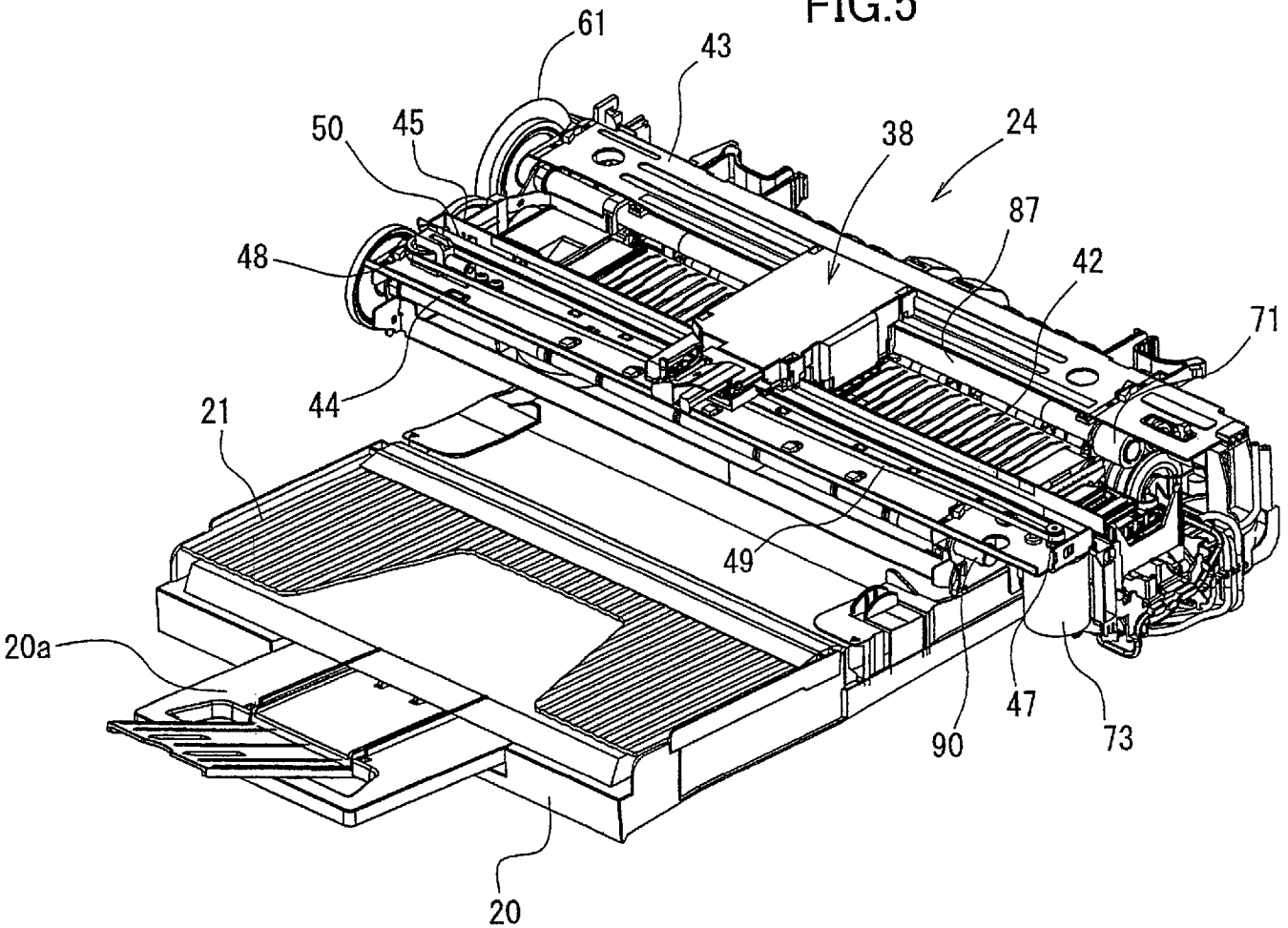
FIG. 5 is a perspective view of a image recording unit 24 of the compound machine 1 in accordance with the first embodiment of the present invention.

FIG. 4 is a plan view showing main configuration of the printer unit 2, mainly, configuration of a part from a substantially center of the printer unit 2 to the back surface side of the device. FIG. 5 is a perspective view showing main configuration of the printer unit 2, that is, configuration of the image recording unit 24.

As shown in FIG. 4 and FIG. 5, a pair of guide rails 43, 44 are disposed above the sheet conveyance path 23. The carriage 38 extends between the guide rails 43, 44 so as to be slidable in the direction perpendicular to the recording sheet conveyance direction.

An edge 45 upstream of the guide rail 44 in the conveyance direction is bent upward at almost right angles. The carriage 38 carried by the guide rails 43, 44 slidably holds the edge 45 with holding members such as a pair of rollers.

As shown in FIG. 4, a belt drive mechanism 46 is disposed on the upper surface of the guide rail 44. The belt drive mechanism 46 is formed by stretching an endless circular timing belt 49 having teeth on an inner side thereof between a driving pulley 47 and a driven pulley 48. A drive force is transmitted from a CR motor 73 to a shaft of the driving pulley 47 (refer to FIG. 5). With rotation of the driving pulley 47, the timing belt 49 is circulated.

As shown in FIG. 4, an encoder strip 50 of a linear encoder 77 (refer to FIG. 8) is disposed at the guide rail 44. A pair of support parts 33, 34 are formed on both ends of the guide rail 44 in the width direction (reciprocation direction of the carriage 38) so as to rise from the upper surface of the guide rail 44.

A pattern in which light-transmitting parts letting light therethrough and light-shielding parts shielding light are alternatively disposed at regular pitches in the longitudinal direction is inscribed on the encoder strip 50. An optical sensor 35 as a transmission sensor is provided at a position corresponding to the encoder strip 50 on the upper surface of the carriage 38.

As shown in FIG. 3 and FIG. 4, the platen 42 is disposed below the sheet conveyance path 23 as opposed to the ink jet recording head 39. The platen 42 is disposed over a central region of a reciprocation range of the carriage 38 where the recording sheet passes. The width of the platen 42 is much larger than a maximum width of the conveyable recording sheet and thus, both ends of the recording sheet certainly pass on the platen 42. As described in detail later, the platen 42 is provided with movable support parts 104 having movable ribs 121 (refer to FIG. 8 to FIG. 12). The movable support parts 104 are slidably driven by a drive mechanism 105 (an example of slide drive means) described later according to a conveyance position of the recording sheet conveyed on the platen 42.

As shown in FIG. 4, a maintenance unit such as a purge mechanism 51 and a waste ink tray 84 are disposed in a region where the recording sheet does not pass, that is, beyond the range of image recording by the ink jet recording head 39. The purge mechanism 51 serves to suck and remove air bubbles and foreign matters which are generated from nozzles 53 of the ink jet recording head 39 (refer to FIG. 6). The purge mechanism 51 is formed of a cap 52 which covers the nozzles 53 of the ink jet recording head 39, a pump mechanism connected to the ink jet recording head 39 through the cap 52 and a moving mechanism for bringing the cap 52 into contact with the nozzles 53 of the ink jet recording head 39 or separating the cap 52 from the nozzles 53 of the ink jet recording head 39. In FIG. 4, since the pump mechanism and the moving mechanism are located below the guide frame 44, the mechanisms are invisible.

As shown in FIG. 1, a door 7 is openably formed on the front surface of a housing of the printer unit 2. As shown in FIG. 4, the above-mentioned four ink tubes 41 corresponding to four colors, respectively, are drawn from a cartridge attachment part to the carriage 38.

Each ink tube 41 derived from the cartridge attachment part is drawn to the almost center of the device along the width direction, and as shown in FIG. 4, is fixed at a fixing clip 36 of the device main unit. In FIG. 4, portions of the ink tubes 41 which extend from the fixing clip 36 toward the cartridge attachment part are not shown.

A record signal or other signals are transmitted from a main substrate forming a control unit 64 (refer to FIG. 15) to a head control substrate of the ink jet recording head 39 through a flat cable 85. The main substrate is disposed on the front surface side of the device (near side in FIG. 4) and is not shown in FIG. 4.

Figure 6:
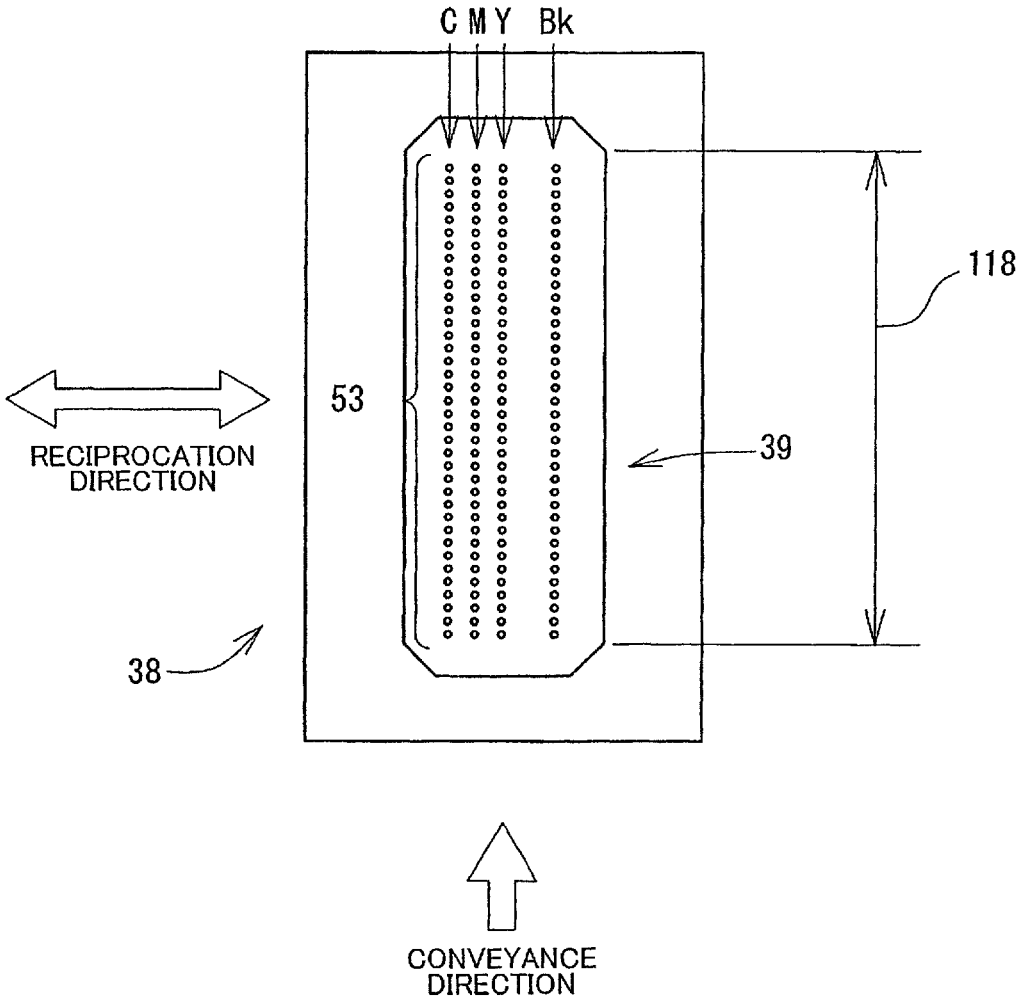
FIG. 6 is a bottom view of an ink jet recording head 39 of the compound machine 1 in accordance with the first embodiment of the present invention.

FIG. 6 is a bottom view of a nozzle forming surface of the ink jet recording head 39. As shown in FIG. 6, the nozzles 53 are provided on the lower surface of the ink jet recording head 39. The nozzles 53 corresponding to the ink colors of cyan (C), magenta (M), yellow (Y) and black (Bk), respectively, are arranged in the recording sheet conveyance direction. In FIG. 6, the vertical direction represents the recording sheet conveyance direction and the horizontal direction represents the reciprocation direction of the carriage 38.

Figure 7:
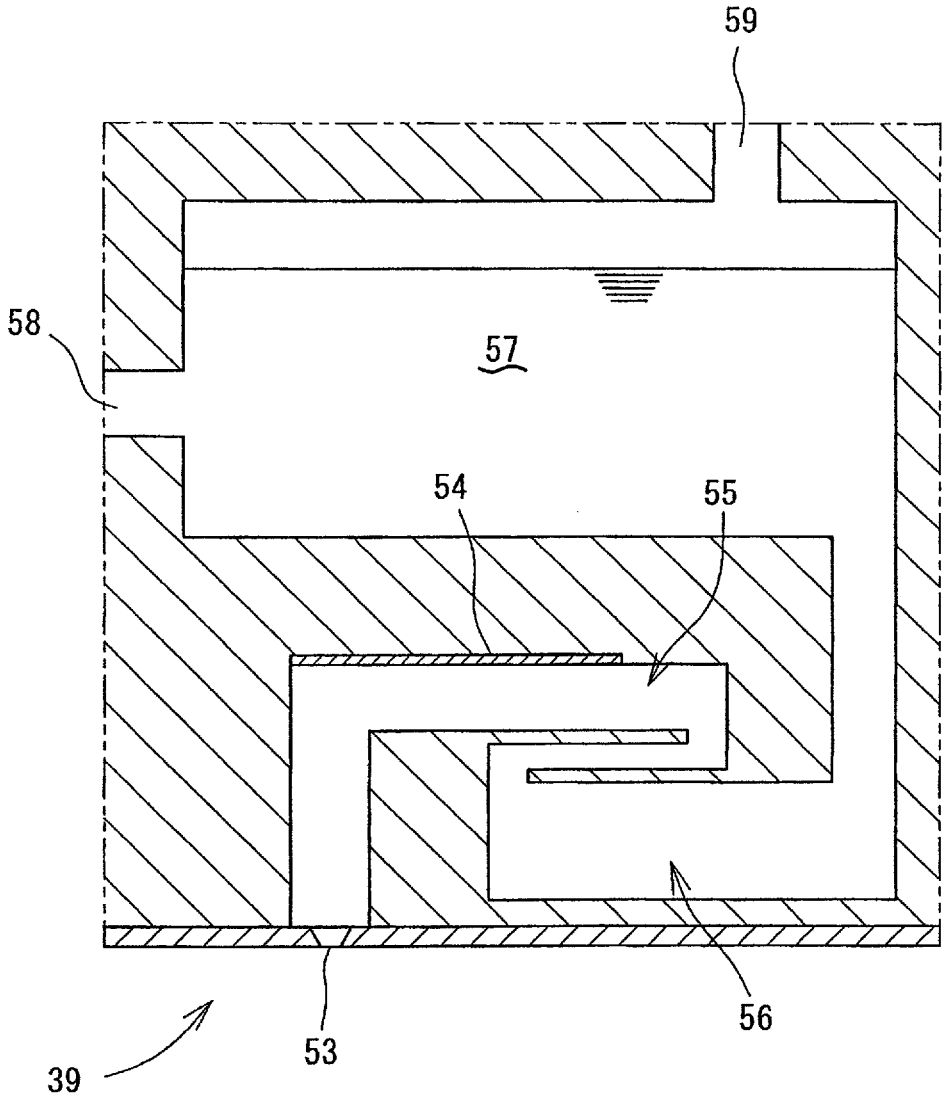
FIG. 7 is a partial enlarged sectional view showing internal configuration of the ink jet recording head 39 of the compound machine 1 in accordance with the first embodiment of the present invention.

FIG. 7 is a partial enlarged sectional view showing internal configuration of the ink jet recording head 39. As shown in FIG. 7, a cavity 55 having a piezoelectric element 54 is formed upstream of the nozzles 53 formed on the lower surface of the ink jet recording head 39.

A manifold 56 is formed in the cavity 55. A buffer tank 57 is disposed upstream of the manifold 56. Ink flowing through the ink tubes 41 is supplied from an ink feed port 58 into the buffer tank 57. Air bubbles captured in the buffer tank 57 are sucked and removed from an air bubble discharge port 59 by the pump mechanism.

As shown in FIG. 3 and FIG. 5, a pair of conveyance rollers 89 having a conveyance roller 87 and a pinch roller 88 are provided upstream of the image recording unit 24. The pinch roller 88 is disposed under the conveyance roller 87 so as to be pressed against each other. The conveyance roller 87 and the pinch roller 88 hold the recording sheet conveyed on the sheet conveyance path 23 therebetween and convey the recording sheet onto the platen 42. The pinch roller 88 is rotatably supported by a pinch roller holder 96 with being pressed against the conveyance roller 87 with a predetermined urging force.

A pair of discharge rollers 92 having a sheet discharge roller 90 and a spur roller 91 provided above the sheet discharge roller 90 are provided downstream of the image recording unit 24. The sheet discharge roller 90 and the spur roller 91 hold the recording sheet on which the image is recorded therebetween and convey the recording sheet to the sheet discharge tray 21. Since the spur roller 91 contacts against the recording sheet on which the image is recorded, the roller surface is irregular in the shape of a spur so that the image recorded on the recording sheet may not deteriorate. The spur roller 91 is provided so as to be slidable in the direction of getting closer to or separating from the sheet discharge roller 90, and is urged to contact against the sheet discharge roller 90 by a coil spring not shown. When the recording sheet enters between the sheet discharge roller 90 and the spur roller 91, the spur roller 91 retreats against the urging force by the thickness of the recording sheet and holds the recording sheet so as to bring the recording sheet into contact with the sheet discharge roller 90. Thereby, a rotational force of the sheet discharge roller 90 is reliably transmitted to the recording sheet.

A driving force is transmitted from the LF motor 71 connected to one end of the conveyance roller 87 in the axial direction (refer to FIG. 5) to the conveyance roller 87, thereby intermittently driving the conveyance roller 87 with a predetermined line feed width. The conveyance roller 87 is coupled to the sheet discharge roller 90 with a transmission mechanism such as a gear. A driving force is transmitted from the conveyance roller 87 to the sheet discharge roller 90 through the transmission mechanism. Consequently, rotation of the conveyance roller 87 is synchronized with rotation of the sheet discharge roller 90. A rotary encoder 76 provided at the conveyance roller 87 (refer to FIG. 15) detects a pattern of an encoder disk 61 rotating with the conveyance roller 87. By controlling the LF motor 71 on the basis of this detection signal, the conveyance roller 87 and the sheet discharge roller 90 are rotationally driven. A rib motor 93 not shown for sliding the above-mentioned movable support parts 104 (refer to FIG. 15) is also controlled on the basis of the detection signal. Thereby, the movable support parts 104 are slidably moved in a predetermined direction at a predetermined timing. A method for driving the movable support parts 104 will be described by using a flow chart of FIG. 16.

The recording sheet held between the conveyance roller 87 and the pinch roller 88 is intermittently conveyed on the platen 42 with a predetermined line feed width. The ink jet recording head 39 is scanned for each line feed to perform image recording starting from the front end side of the recording sheet. The front end of the recording sheet on which the image is recorded is held between the sheet discharge roller 90 and the spur roller 91. That is, the front end of the recording sheet is held between the sheet discharge roller 90 and the spur roller 91 and the rear end of the recording sheet is held between the conveyance roller 87 and the pinch roller 88. In this state, the recording sheet is intermittently conveyed with the predetermined line feed width and image recording is performed by the ink jet recording head 39 for each line feed. When the recording sheet is further conveyed, the rear end of the recording sheet escapes from between the conveyance roller 87 and the pinch roller 88 and is released from the pair of conveyance rollers 89. That is, the recording sheet is held only between the sheet discharge roller 90 and the spur roller 91 and intermittently conveyed. Image recording is performed by the ink jet recording head 39 for each line feed. After image recording is performed on a predetermined region of the recording sheet, the sheet discharge roller 90 is rotationally driven continuously. Thereby, the recording sheet held between the sheet discharge roller 90 and the spur roller 91 is discharged to the sheet discharge tray 21.

A regi-sensor 95 is located upstream of the pair of conveyance rollers 89 on the sheet conveyance path 23. The regi-sensor 95 has a sensor in FIG. 3 and an optical sensor not shown. The sensor is disposed so as to appear or disappear on the sheet conveyance path 23. The sensor is elastically urged to protrude from the sheet conveyance path 23 at all times. The sensor is rotated so as to disappear on the sheet conveyance path 23 by contacting against the conveyed recording sheet. Depending on appearance or disappearance of the sensor, the above-mentioned optical sensor is turned ON or OFF. By allowing the sensor to appear by the recording sheet in this manner, the front end or the rear end of the recording sheet on the sheet conveyance path 23 is detected.

In the compound machine 1 in accordance with this embodiment, as described above, the LF motor 71 is a driving source for feeding of the recording sheet from the sheet feed tray 20, conveyance of the recording sheet on the platen 42 and discharge of the recording sheet on which the image is recorded to the sheet discharge tray 21. That is, the LF motor 71 drives drive shafts of the conveyance roller 87 and the sheet discharge roller 90 through a predetermined power transmission mechanism formed of a gear train and a timing belt (refer to FIG. 5) and drives the sheet feed tray 25 through the drive transmission mechanism 27.

Figure 8:
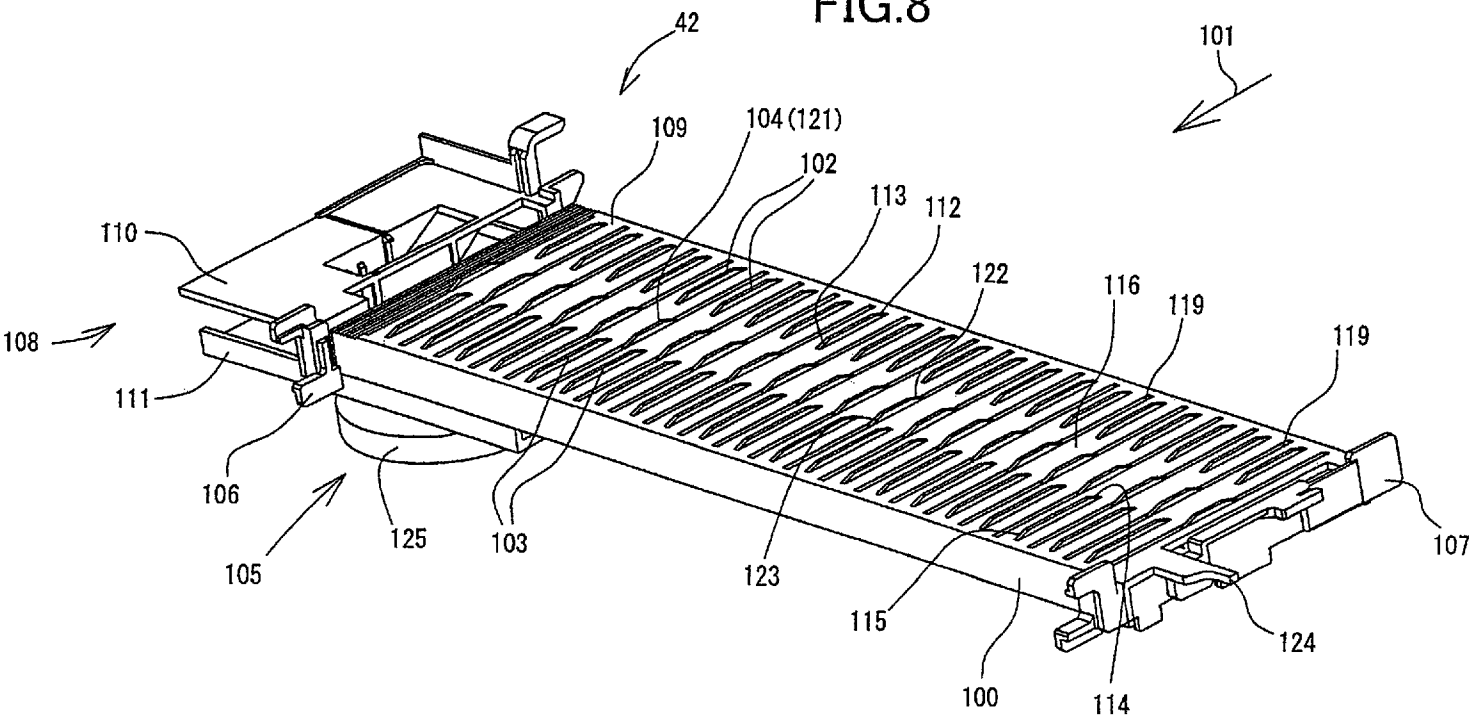
FIG. 8 is an enlarged perspective view of a main part in FIG. 5.
Figure 9:
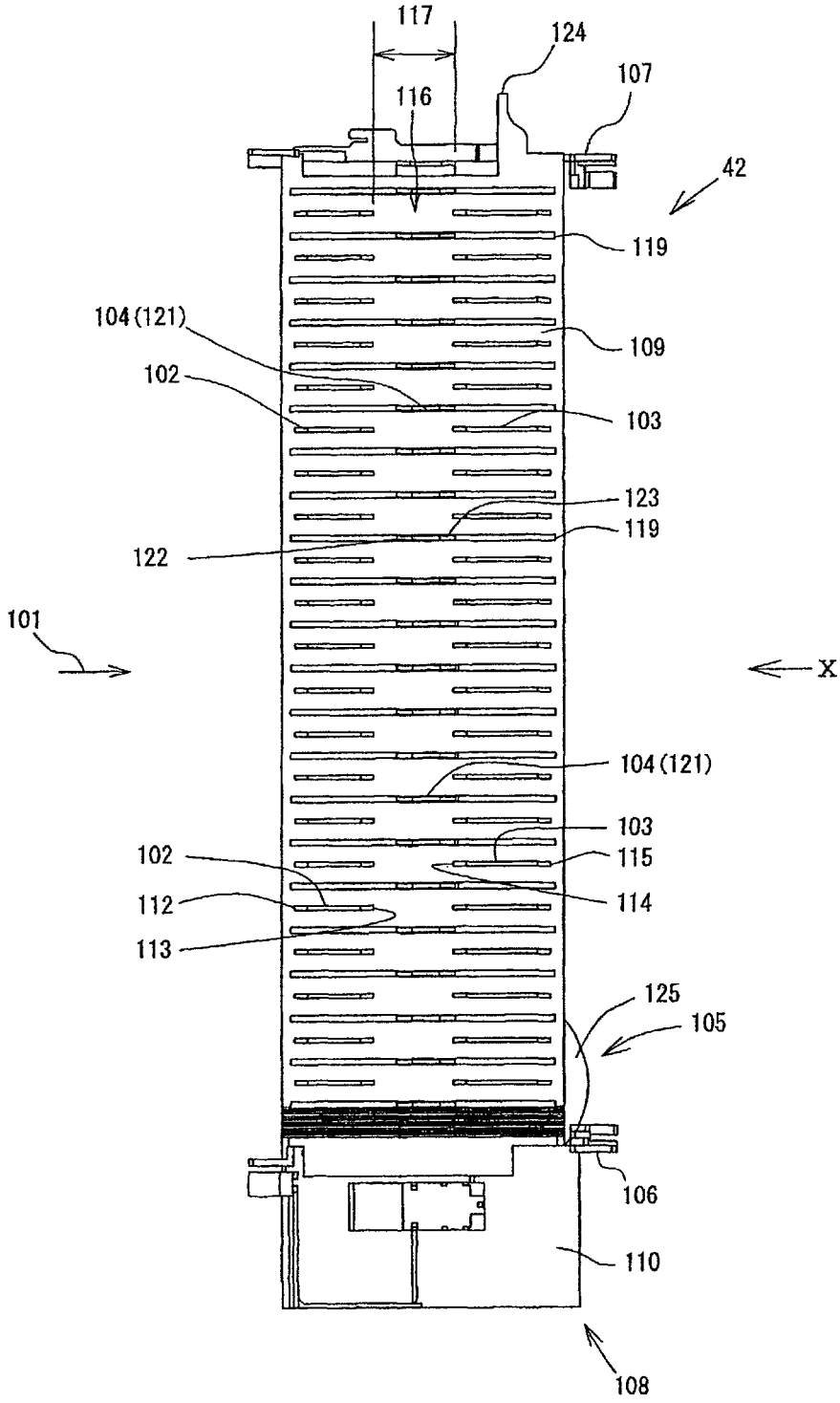
FIG. 9 is a plan view of a platen 42 of the compound machine 1 in accordance with the first embodiment of the present invention.
Figure 10:
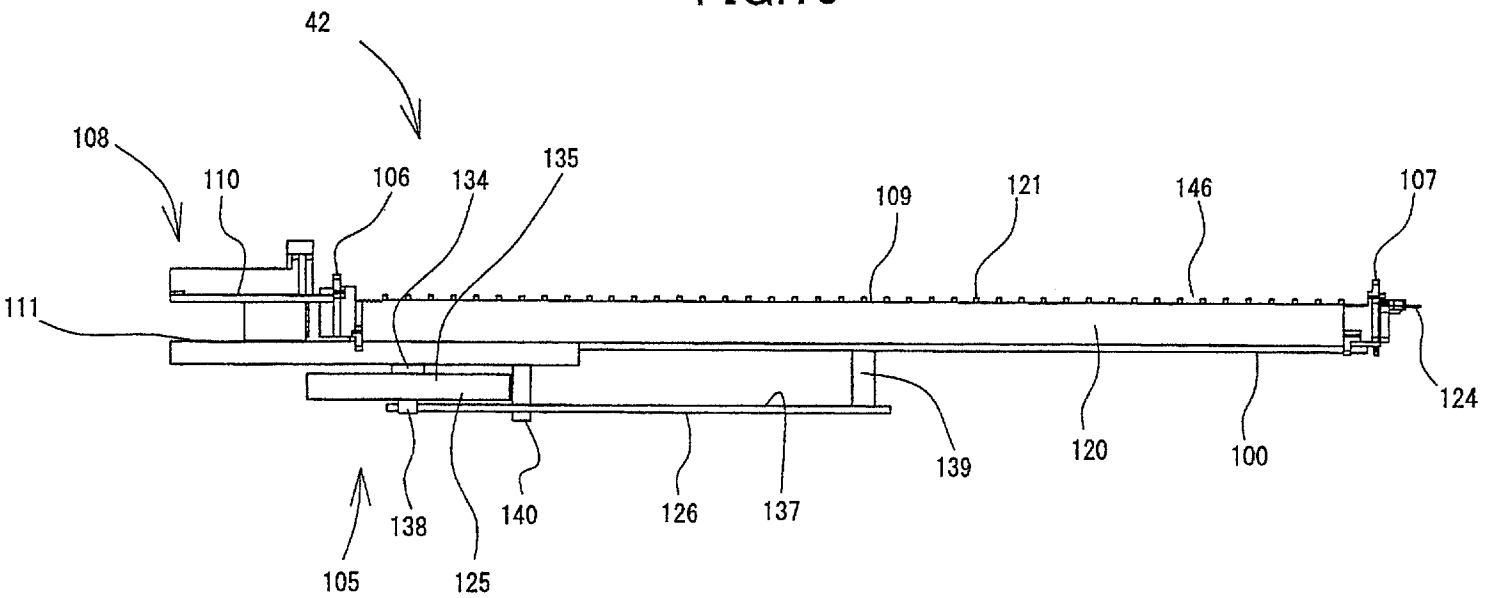
FIG. 10 is a view of the platen 42 viewed from the direction of an arrow X in FIG. 9.
Figure 11:
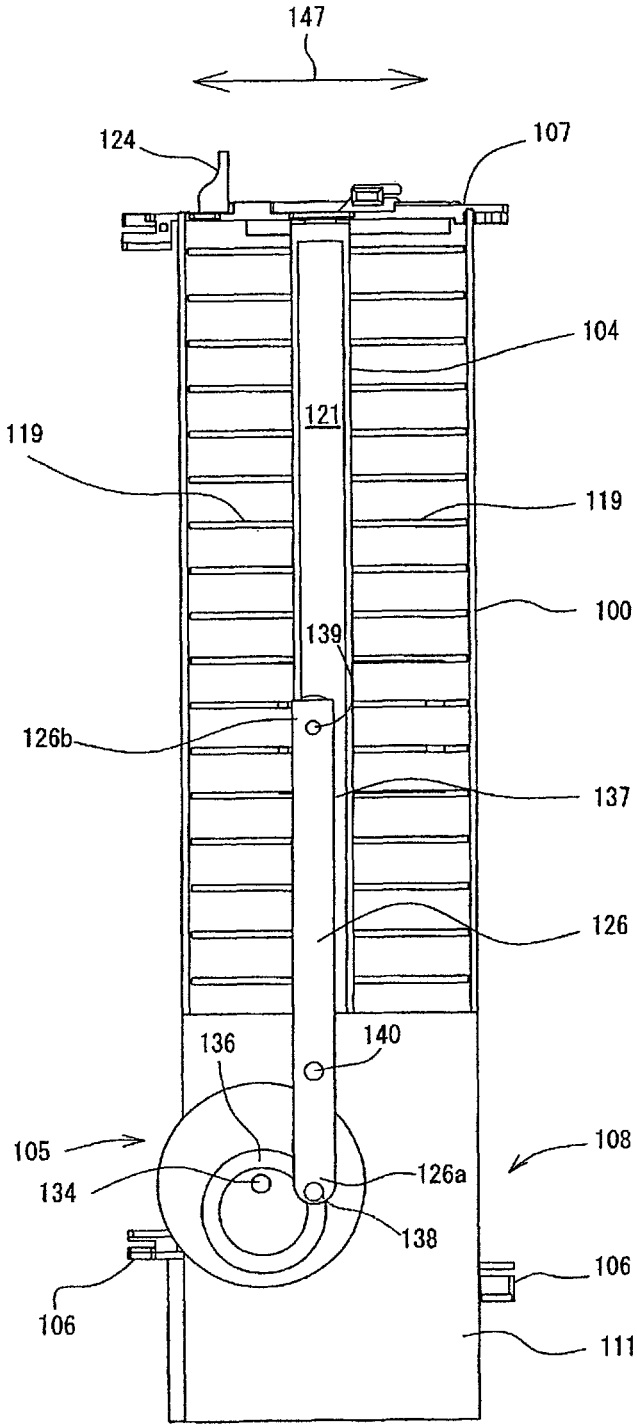
FIG. 11 is a bottom view of the platen 42 of the compound machine 1 in accordance with the first embodiment of the present invention.
Figure 12:
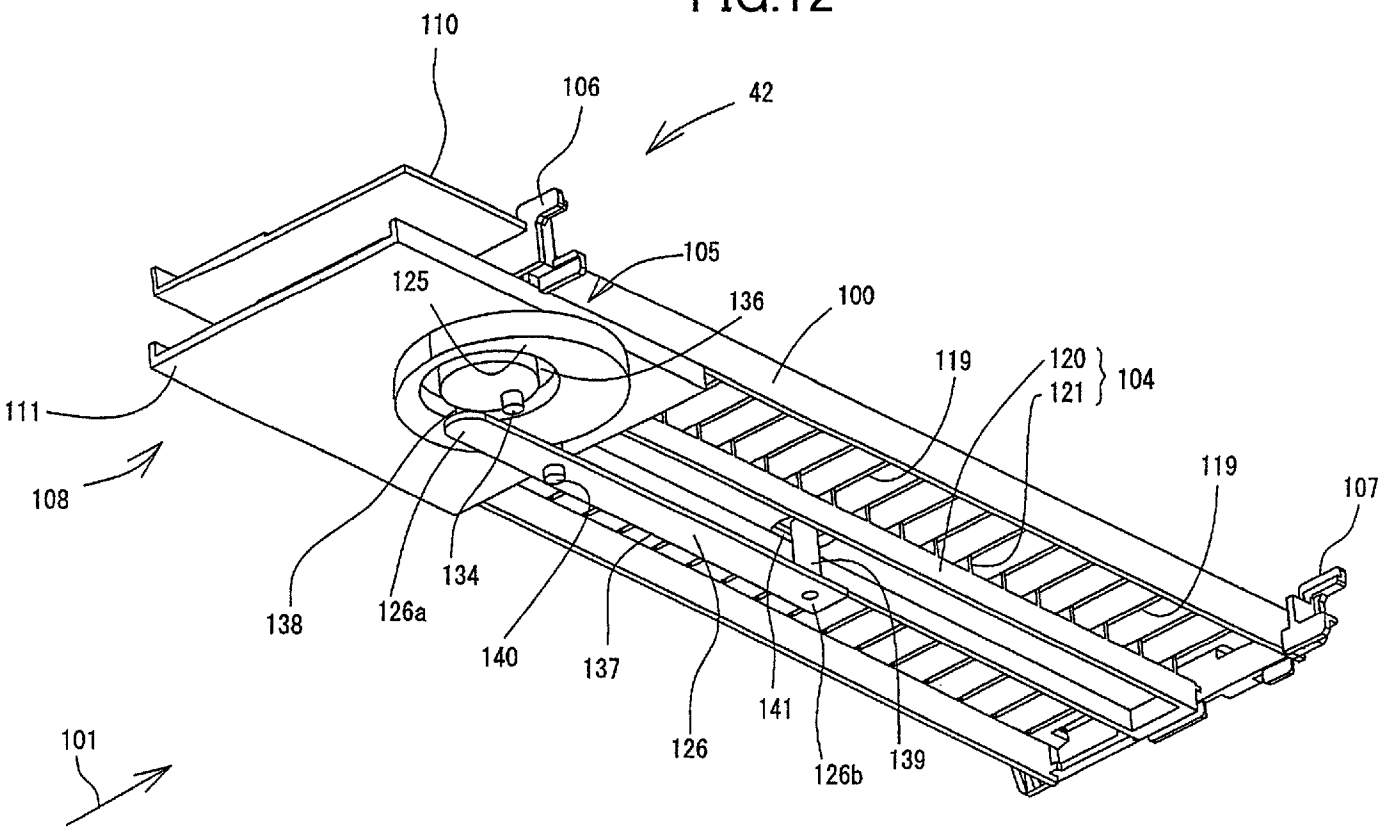
FIG. 12 is a perspective view of the platen 42 of the compound machine 1 in accordance with the first embodiment of the present invention viewed from a bottom face.

FIG. 8 is an enlarged perspective view of a main part in FIG. 5, that is, the platen 42. FIG. 9 is a plan view of the platen 42. The FIG. 10 is a view of the platen 42 viewed from the direction of an arrow X in FIG. 9. FIG. 11 is a bottom view of the platen 42. FIG. 12 is a perspective view of the platen 42 viewed from a bottom surface.

As described above, the platen 42 is located as opposed to the recording head 39 (below the recording head 39 in FIG. 3) and supports the conveyed recording sheet (refer to FIG. 3 and FIG. 5). As shown in FIG. 8, the platen 42 is shaped like an elongated rectangular thin plate as a whole. The platen 42 is located so that the longitudinal direction extends along the main scanning direction. In the figure, a direction represented by an arrow 101 is the conveyance direction. The recording sheet is conveyed in the direction of the arrow 101 by the pair of conveyance rollers 89 and the pair of sheet discharge rollers 92.

The platen 42 has a frame 100, first fixing ribs 102 and second fixing ribs 103 which are provided on the frame 100, the movable support parts 104 slidably provided on the frame 100 and the drive mechanism 105 which slidably drives the movable support parts 104 as described below.

The frame 100 is made of, for example, synthetic resin or steel plate and constitutes a framework of the platen 42. The frame 100 is formed so as to a substantially C-like cross section (so-called channel type). As shown in FIG. 8 to FIG. 12, brackets 106, 107 are formed at the bottom end and the front end of the frame 100, respectively. These brackets 106, 107 are formed integrally with the frame 100. The frame 100 is fixed to the compound machine 1 via the brackets 106, 107 (refer to FIG. 3 and FIG. 5). In FIG. 9, the right side represents the front end of the frame 100 and the left side represents the bottom end of the frame 100.

A drive mechanism attachment part 108 is provided at the bottom end of the frame 100. As shown in FIG. 8 to FIG. 12, especially, FIG. 8 and FIG. 12, the drive mechanism attachment part 108 extends from the bottom end of the frame 100 and has a top plate 110 provided on the side of an upper surface 109 of the frame 100 and a bottom plate 111 provided on the side of a lower surface of the frame 100. Both the top plate 110 and the bottom plate 111 are rectangular and formed integrally with the frame 100. The bottom plate 111 supports the drive mechanism 105 described in detail later.

The first fixing ribs 102 and the second fixing ribs 103 are formed on the upper surface 109 of the frame 100. Specifically, the first fixing ribs 102 are provided near the upstream end of the upper surface 109 in the conveyance direction and protrude upward (toward the recording head 39). The second fixing ribs 103 are provided near the downstream end of the upper surface 109 in the conveyance direction and protrude upward. As shown in FIG. 8, the first fixing ribs 102 and the second fixing ribs 103 each are formed of a rectangular thin plate-like member and vertically provided on the upper surface 109.

In this embodiment, the plurality of first fixing ribs 102 are formed on the upper surface 109 and aligned in the main scanning direction. Similarly, the plurality of second fixing ribs 103 are formed on the upper surface 109 and aligned in the main scanning direction. In the figures, a part of the fixing ribs are given reference numerals. By providing the plurality of first fixing ribs 102 and second fixing ribs 103, a groove 116 are formed between the first fixing rib 102 and the second fixing rib 103. As shown in FIG. 8 and FIG. 9, the groove 116 extends in the main scanning direction as well as spread in the conveyance direction.

The width dimension (dimension in the conveyance direction) of the groove 116 corresponds to size of the recording head 39. Specifically, the width dimension (dimension in the conveyance direction) W of the groove 116 (refer to FIG. 9) is set to be larger than an ink ejection region 118 of the recording head 39 (refer to FIG. 6). The width dimension (dimension in the conveyance direction) W of the groove 116 corresponds to size of the ink jet recording head 39 and is set to be larger than a maximum use region 118 of the ink jet recording head 39 (refer to FIG. 6). Effects obtained by setting the width dimension W of the groove 116 to be larger than the maximum use region 118 will be described in detail later.

In this embodiment, as shown in FIG. 9, one first fixing rib 102 is opposed to one second fixing rib 103 across the groove 116 in the conveyance direction (direction of the arrow 101). As shown in FIG. 8, corners 112, 113 of each first fixing ribs 102 are chamfered to form a pair of inclined planes. In this embodiment, the inclined planes of the corners 112, 113 are formed on the both sides of the first fixing ribs 102 in the conveyance direction. However, the inclined planes only need to be formed on at least the corners 112 on the upstream side in the conveyance direction. Similarly, the corners 114, 115 of each second fixing ribs 103 are chamfered to form a pair of inclined planes. In this embodiment, the inclined planes of the corners 114, 115 on the both sides of the second fixing ribs 103 in the conveyance direction. However, the inclined planes only need to be formed on at least the corners 114 on the upstream side in the conveyance direction. Effects obtained by chamfering the corners 112 to 115 of the first fixing ribs 102 and the second fixing ribs 103 will be described later.

A plurality of slits 119 are formed on the upper surface 109 of the frame 100. As shown in FIG. 8, the slits 119 extend from the upstream end to the downstream end of the upper surface 109 in the conveyance direction. Each slit 119 is formed continuously between the adjacent first fixing ribs 102 and between the adjacent second fixing ribs 103. The movable ribs 121 of the movable support parts 104 are fitted into the slits 119 from the lower surface to the upper surface 109 of the frame 100 and protrude upward from the slits 119.

Specifically, each movable support part 104 is, as shown in FIG. 12, formed of a box-like base 120 and the movable rib 121 made of a rectangular thin plate-like member. The movable support parts 104 may be made of synthetic resin or metal. The base 120 is formed of a channel member having a C-like cross section and fitted into the inner side of the frame 100. Although not shown, both ends of the base 120 in the main scanning direction are slidably supported by the frame 100. Accordingly, the base 120 can smoothly slide inside of the frame 100 in the conveyance direction (the direction of an arrow 147 in FIG. 11).

The movable ribs 121 are formed on the upper surfaces of the bases 120. The movable ribs 121 are formed integrally with the base 120. The movable ribs 121 are rectangular and protrude upward from the upper surface 109 of the frame 100 through the slits 119. The plurality of movable ribs 121 are provided on the upper surface of the base 120. Specifically, the plurality of movable ribs 121 are aligned on the upper surface of the base 120 with a predetermined distance therebetween along main scanning direction. The predetermined distance corresponds to the pitch of the slits 119. Thus, the plurality of movable ribs 121 protrude upward from the slits 119. In the figures, a part of the movable ribs 121 are given reference numerals.

Figure 13:
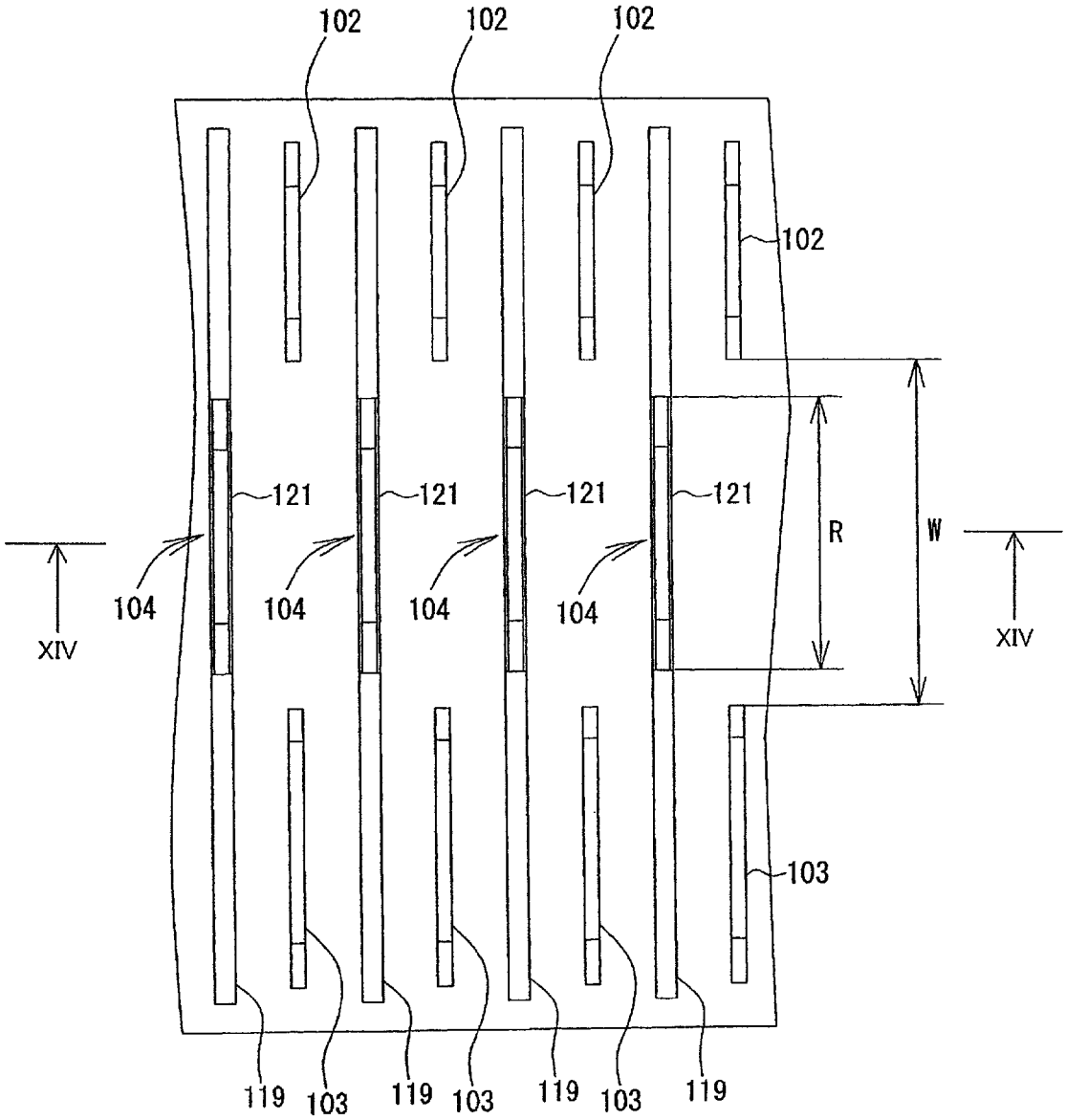
FIG. 13 is an enlarged view of a main part in FIG. 9.
Figure 14:
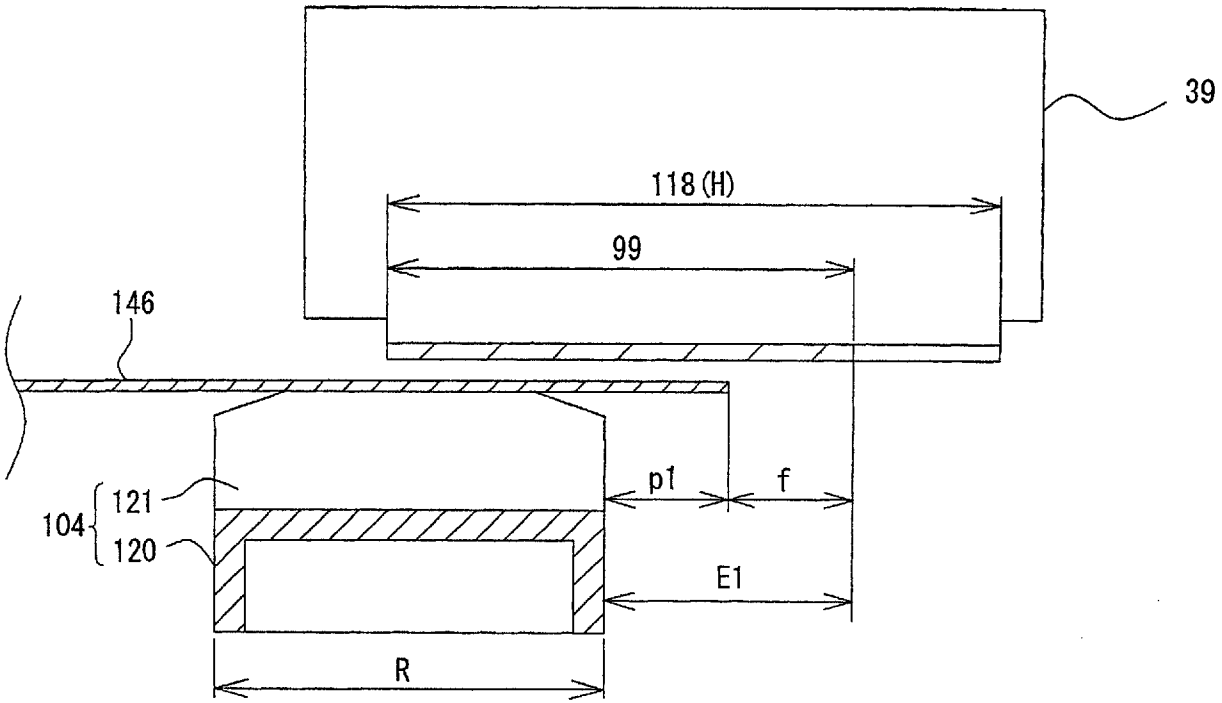
FIG. 14 is a view of the main part taken along a line XVI-XVI.

FIG. 13 is an enlarged view of the main part in FIG. 9. FIG. 14 is a view showing positional relationship among the movable ribs 121, the recording sheet 146 and the ink jet recording head 39 when borderless recording is performed, taken along a line XIV-XIV in FIG. 13.

As shown in FIG. 14, when ink drops are ejected to the recording sheet 146 conveyed on the platen 42 from the ink jet recording head 39, an use region 99 of the ink jet recording head 39 is set to overhang from the front end of the recording sheet 146 in the conveyance direction by a distance f. The distance f is determined by controlling the nozzles 53 used by the control unit 64 (refer to FIG. 7). In this figure, the distance f is set on the front end side of the recording sheet 146. However, the distance f may be similarly set on the rear end side of the recording sheet 146. The distance f is set to about 0.5 mm to 7 mm. In this embodiment, the distance f is set to about 3.5 mm on both the front end side and the rear end side of the recording sheet 146.

When the borderless recording is performed, the recording sheet 146 is positioned so that the front end may overhang from the movable ribs 104 in the conveyance direction (specifically, from the movable ribs 121 in the conveyance direction) by a predetermined distance p1. The position of the recording sheet 146 is adjusted by controlling rotation of the LF motor 71 by use of the control unit 64 (refer to FIG. 15). The distance p1 is an allowable distance by which the recording sheet 146 overhangs on the downstream side in the conveyance direction so as to be supported by the movable ribs 121 without hanging down. The distance p1 is determined depending on the type of the recording sheet 146 and generally set to 0. 5 mm to 8 mm. For example, when the recording sheet 146 is plain paper of A4 size, p1 is set to 3.5 mm. In this figure, the distance p1 is set on the front end side of the recording sheet 146. However, similarly, a distance p2 is set on the rear end side of the recording sheet 146. In this embodiment, the distance p1 and the distance p2 are set to the same value.

Here, a distance E1 obtained by adding the distance p1 to the distance f is defined on the front end side of the recording sheet 146 and a distance E2 obtained by adding the distance p2 to the distance f is defined on the rear end side of the recording sheet 146. That is, these distances E1, E2 each are set to about 1 mm to 1.3 mm. In this embodiment, both the distances E1 and E2 are set to 7.0 mm. As shown in FIG. 13 and FIG. 14, a length R of the movable ribs 104 (more specifically, the movable ribs 121) in the conveyance direction is set to be smaller than the width dimension W of the groove 116. Given that a length of the maximum use region 118 of the ink jet recording head 39 in the conveyance direction when borderless recording is performed is H, R is set so as to satisfy R=H−(E1+E2). In this embodiment, since the length H of the maximum use region 118 in the conveyance direction is set to 24.9 mm, the length of the movable ribs 121 in the conveyance direction is set to 10.9 mm. The length H may be the size in the case where all of the nozzles 53 provided at the ink jet recording head 39 are used or the size in the case where the nozzle 53 located at the border is eliminated in consideration of accuracy of ejecting ink drops of the nozzle 53 located at the border. Furthermore, in this embodiment, the width dimension W of the groove 116 is set to 30.9 mm. However, if the width dimension W of the groove 116 may be set to another size as long as W>R+E1+E2 is satisfied.

Like the first fixing ribs 102 and the second fixing ribs 103, corners 122, 123 of the movable ribs 121 are chamfered to form a pair of inclined planes. In this embodiment, the inclined planes of the corners 122, 123 are formed on the both sides of the movable ribs 121 in the conveyance direction. However, the inclined planes only need to be formed on at least the corners 122 on the upstream side in the conveyance direction. Since the corners 122, 123 of the movable ribs 121 are chamfered in this manner, even when the end of the recording sheet 146 which passes through the first fixing rib 102 comes into contact with the corner 122 of the movable support part 104, the end of the recording sheet 146 is smoothly guided to the upper surface of the movable support part 104. Thus, the movable support parts 104 do not prevent smooth conveyance of the recording sheet 146. Similarly, as described above, since the corners 112 to 115 of the first fixing ribs 102 and the second fixing ribs 103 are chamfered to form inclined planes, even when the recording sheet 146 during conveyance comes into contact with the corners 112 to 115, smooth conveyance of the recording sheet 146 is not prevented.

The drive mechanism 105 serves to slide the movable support parts 104 in the recording sheet conveyance direction and has, as shown in FIG. 11 and FIG. 12, a pulley 125 and a swing member 126. A timing belt not shown for transmitting a rotational force to the pulley 125 and the rib motor 93, an output shaft of which is connected to the timing belt (refer to FIG. 15), is further provided. In this embodiment, a stepping motor which requires no feedback control is used as the rib motor 93. By controlling the rib motor 93 as described below, a driving force of the rib motor 93 is transmitted to the pulley 125 through the timing belt and then, from the pulley 125 to the swing member 126. Thereby, the swing member 126 is moved in the recording sheet conveyance direction. In this embodiment, the driving force of the rib motor 93 is transmitted to the swing member 126 by the timing belt and the pulley 125. However, as a matter of course, a transmission mechanism such as a gear may be used in place of the timing belt and the pulley 125.

The pulley 125 is shaped like a disc and is rotatably supported by a rotational center shaft 134. The rotational center shaft 134 is fixed to the frame 100 (specifically, the bottom plate 111) and inserted into the center of the pulley 125. The pulley 125 has a circular groove 136. The circular groove 136 is shaped like a ring and the center of the circular groove 136 does not correspond to the center of the pulley 125. That is, the circular groove 136 is eccentric to the center of the pulley 125. The circular groove 136 is engaged with a bottom end 126*a* of the swing member 126.

The swing member 126 has a main body 137 formed of an elongated flat plate, an engaging pin 138 provided at the bottom end 126*a* of the swing member 126 (the bottom end 126*a* of the main body 137) (refer to FIG. 12) and an engaging sod 139 provided at a front end 126*b*. The swing member 126 is also made of synthetic resin or metal. The main body 137 is rotatably supported by a swing center shaft 140. The swing center shaft 140 is fixed to the bottom plate 111 of the drive mechanism attachment part 108 and inserted into a predetermined position of the bottom end 126*a* from the center of the main body 137. The engaging pin 138 is formed so as to protrude upward from the main body 137 (refer to FIG. 11) and fitted into the circular groove 136 of the pulley 125. An outer diameter of the engaging pin 138 corresponds to the groove width dimension of the circular groove 136. The engaging pin 138 can slide relatively along the circular groove 136 without rattling. A publicly known slide mechanism may be used as such configuration.

When the engaging pin 138 is relatively displaced along the circular groove 136, the main body 137 is rotated about the swing center shaft 140. That is, the swing member 126 swings about the swing center shaft 140. Thereby, the engaging rod 139 provided at the front end 126*b* of the main body 137 slides in the form of an arc around the swing center shaft 140. The engaging rod 139 is coupled to the base 120 of the movable support parts 104. The base 120 has a long hole 141 extending in the longitudinal direction (that is, the main scanning direction) and the engaging rod 139 is fitted into the long hole 141. The outer diameter of the engaging rod 120 corresponds to the inner diameter of the long hole 141. No rattling between the engaging rod 139 and the long hole 141 occurs in directions other than the scanning direction.

Thus, as described above, when the main body 137 swings and the engaging rod 139 slides in the form of an arc around the swing center shaft 140, the engaging rod 139 slides along the long hole 141 in the main scanning direction and the base 120 is moved in the recording sheet conveyance direction. As described above, since the both ends of the base 120 in the main scanning direction are slidably supported by the frame 100, the base 120 smoothly slides within the frame 100 and on a virtual plane which is parallel to the upper surface 109 of the frame 100 in the conveyance direction (the direction of the arrow in FIG. 11). In other words, by swinging the swing member 126, the movable support parts 104 slide in the conveyance direction.

In this embodiment, the circular groove 136 is formed so that the movable support parts 104 may slide between a position T1 (refer to FIG. 17) and a position T4 (refer to FIG. 19) described below. The slide range of the movable support parts 104 is not necessarily a range between the position T1 and the position T4. The slide range should be at least a range between a position T3 at which the end of the first fixing rib 102 on the side of the groove 116 substantially coincides with the upstream end of the movable rib 121 (refer to FIG. 18, FIG. 19) and a position T2 at which the end of the second fixing rib 103 on the side of the groove 116 substantially coincides with the downstream end of the movable rib 121.

Figure 15:
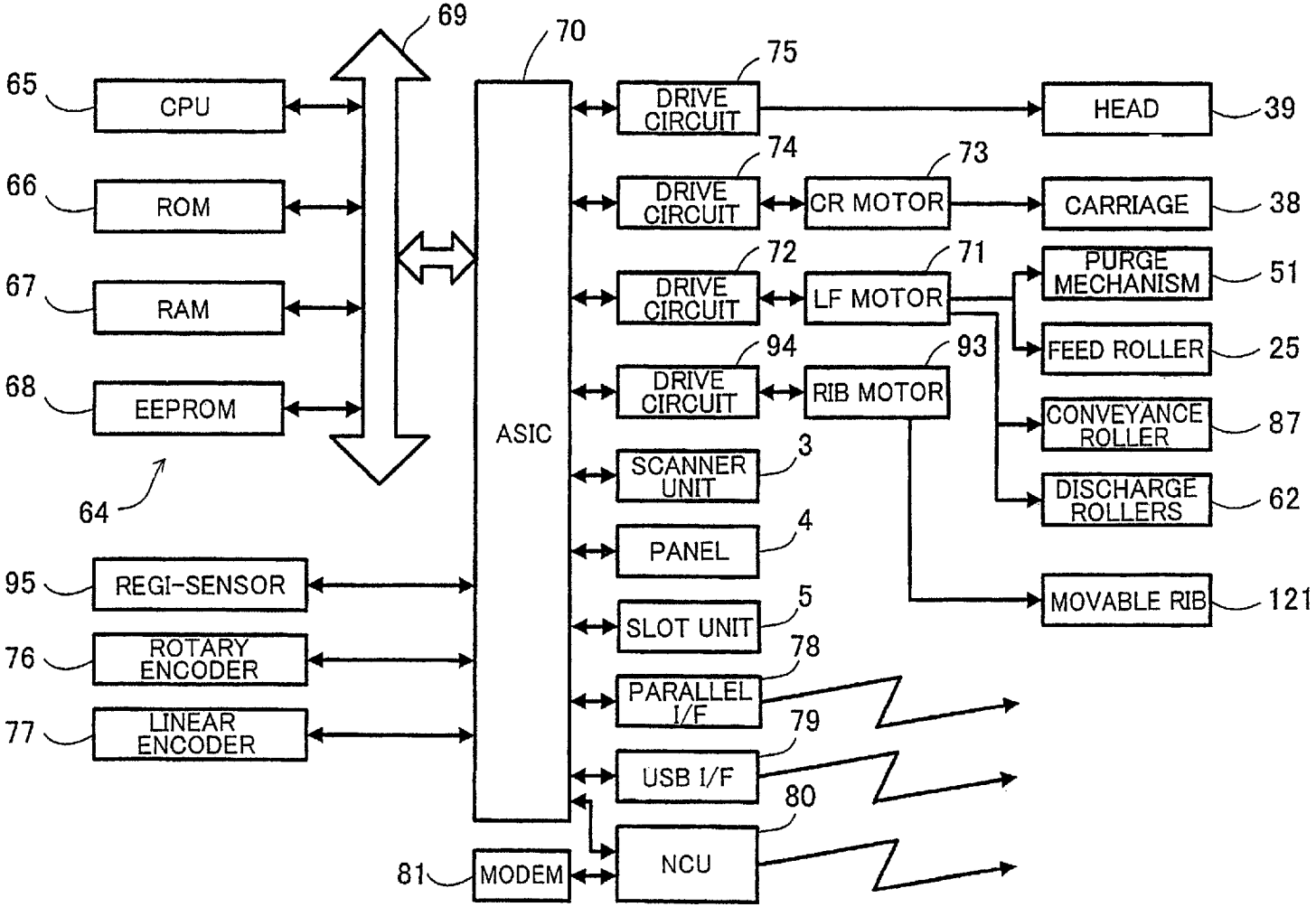
FIG. 15 is a block diagram showing configuration of a control unit 64 of the compound machine 1 in accordance with the first embodiment of the present invention.

FIG. 15 is a block diagram showing configuration of the control unit 64 of the compound machine 1.

The control unit 64 controls an overall operation of the compound machine 1 including the printer unit 3 as well as the scanner unit 2 and is formed of a main substrate connected to the flat cable 85. Since configuration of the scanner unit 3 is not main configuration according to the present invention, detailed description thereof is omitted.

As shown in FIG. 15, the control unit 64 is formed of a micro computer 33 mainly having a CPU (Central Processing Unit) 65, a ROM (Read Only Memory) 66, a RAM (Random Access Memory) 67 and an EEPROM (Electrically Erasable and Programmable ROM) 68 and is connected to an ASIC (Application Specific Integrated Circuit) 70 via a bus 69.

The ROM 66 stores a program for controlling various operations of the compound machine 1 and table data used for control therein. The RAM 67 is used as a storage area or a work area for temporarily storing various data used when the CPU 65 executes the above-mentioned program therein. The EEPROM 68 stores setting and flags which should be held after power-off.

In response to an instruction of the CPU 65, the ASIC 70 generates a phase excitation signal for passing an electric current to the LF motor 71, the CR motor 73 and the rib motor 93. This signal is given to drive circuits 72, 74, 94 for driving the motors 71, 73, 94. The drive signal is passed to the motors 71, 73, 94 through the drive circuits 72, 74, 94. In this manner, rotation of the motors 71, 73, 94 is controlled.

The drive circuit 72 drives the LF motor 71 connected to the sheet feed tray 25, the conveyance roller 87, the sheet discharge roller 90 and the purge mechanism 51 and generates an electric signal for rotating the LF motor 71 in response to an output signal, sent from the ASIC 70. In response to the electric signal, the LF motor 71 is rotated. A rotational force of the LF motor 71 is transmitted to the sheet feed tray 25, the conveyance roller 87, the sheet discharge roller 90 and the purge mechanism 51 through the publicly known drive transmission mechanism formed of a gear and a drive shaft. That is, as described above, in the compound machine 1 in accordance with this embodiment, the LF motor 71 acts as a drive source for feeding of the recording sheet from the sheet feed tray 20, conveyance of the recording sheet located on the platen 42 and discharge of the recording sheet on which the image is recorded to the sheet discharge tray 21.

The drive circuit 74 drives the CR motor 73 and in response to the output signal sent from the ASIC 70, generates an electric signal for rotating the CR motor 73. In response to the electric signal, the CR motor 73 is rotated. A rotational force of the CR motor 73 is transmitted to the carriage 38 through the belt drive mechanism 46, thereby reciprocating the carriage 38. In this manner, the reciprocating motion of the carriage 38 is controlled by the control unit 64.

The drive circuit 94 drives the rib motor 93 and in response to the output signal sent from the ASIC 70, generates an electric signal for rotating the rib motor 93. In response to the electric signal, the rib motor 93 is rotated. A rotational force of the rib motor 93 is transmitted to the swing member 126 through the drive mechanism 105 (refer to FIG. 12). When the rotational force is transmitted to the movable support parts 104, the movable support parts 104 are slid in the recording sheet width direction. Thereby, the movable ribs 121 are slidingly moved on the platen 42 in the conveyance direction. Sliding of the movable support parts 104 by the control unit 64 will be described below with reference to a flow chart of FIG. 16.

The drive circuit 75 drives the ink jet recording head 39 at a predetermined timing. On the basis of a drive control procedure output from the CPU 65, the drive circuit 75 receives the output signal generated by the ASIC 70 and controls driving of the ink jet recording head 39. The drive circuit 75 is mounted in the head control substrate to transmit a signal from a main substrate forming the control unit 64 to the head control substrate through the flat cable 85. Thereby, the ink jet recording head 39 selectively ejects ink of each color to the recording sheet at a predetermined timing.

The ASIC 70 is connected to the rotary encoder 76 for detecting rotation of the conveyance roller 87, the linear encoder 77 for detecting position of the carriage 38 and the regi-sensor 95 for detecting the front end and the rear end of the recording sheet (refer to FIG. 3). On turning on the compound machine 1, the carriage 38 is moved to ends of the guide rails 43, 44 to initiate detection position of the linear encoder 77. When the carriage 38 is moved on the guide rails 43, 44 from the initial position, the optical sensor 35 provided on the carriage 38 detects the pattern of the encoder strip 50. The number of pulse signals based on the pattern is grasped by the control unit 64 as movement of the carriage 38. On the basis of the movement, to control the reciprocating motion of the carriage 38, the control unit 64 control rotation of the CR motor 73. The control unit 64 grasps position of the front end and the rear end of the recording sheet on the basis of a signal of the regi-sensor 95 and encoded quantity detected by the rotary encoder 76 and when the front end of the recording sheet reaches a predetermined position of the platen 42, controls rotation of the LF motor 71 to intermittently convey the recording sheet for each predetermined line feed width. The line feed width is set based on resolution or the like input as a record condition. When borderless recording on the recording sheet is performed, the control unit 64 controls rotation of the LF motor 71 so that the use region 99 of the ink jet recording head 39 overhang from the recording sheet by the distance f in the conveyance direction. The overhang distance f can be set to 0.5 mm to 7 mm.

The ASIC 70 is connected to the scanner unit 3, the operation panel 4 for instructing operations of the compound machine 1, the slot unit 5 for inserting various small-sized memory cards thereinto, and a parallel interface 78 and an USB interface 79 for receiving/transmitting data from/to an external information device such as a personal computer through a parallel cable or an USB cable. The ASIC 70 is further connected to an NCU (Network Control Unit) 80 and a modem 81 for performing a faxing function.

Figure 16:
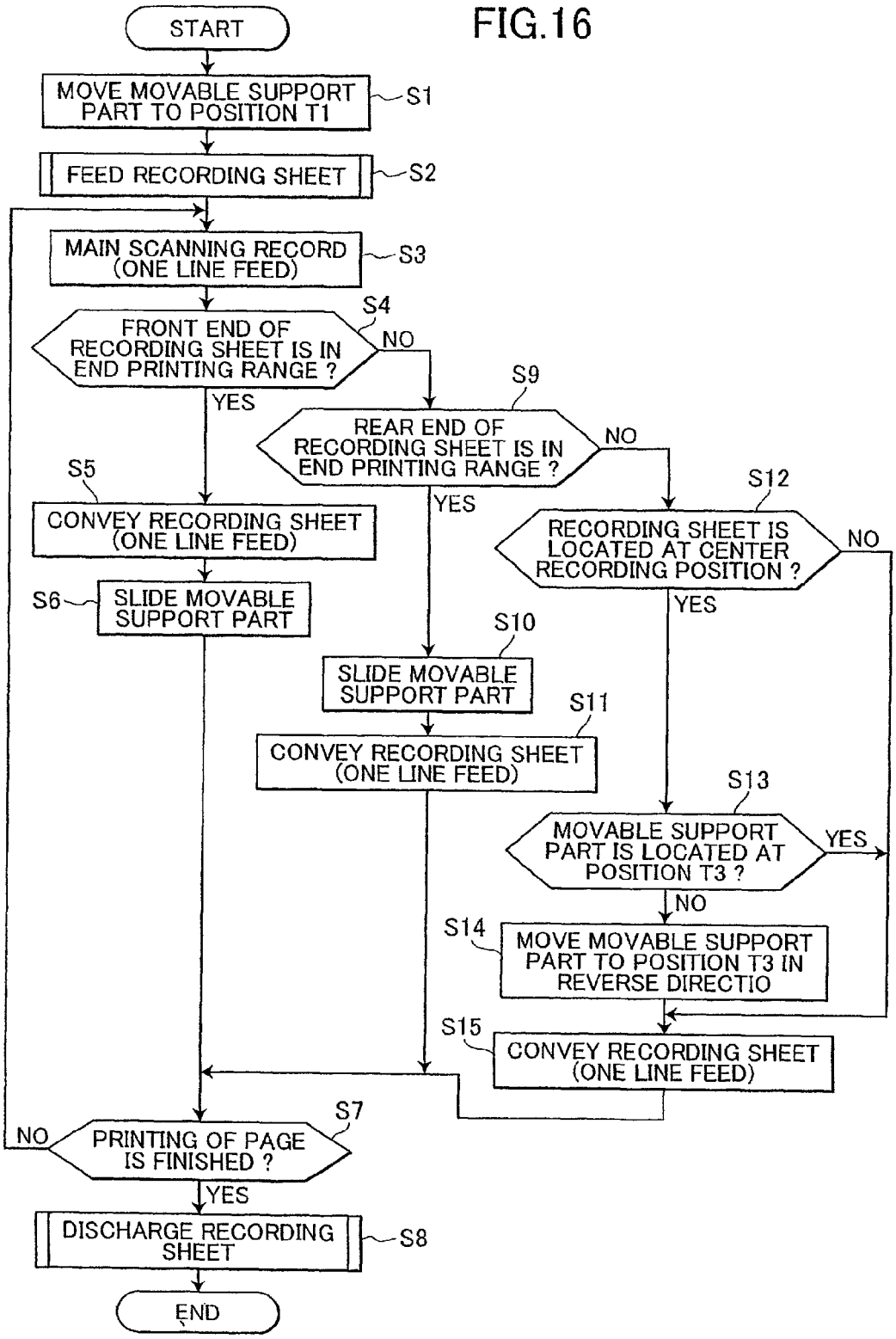
FIG. 16 is a flow chart for illustrating an example of procedure of slide control processing executed by the control unit 64 in accordance with the first embodiment of the present invention.

Referring to a flow chart of FIG. 16 and schematic views of FIG. 17 to FIG. 19, an example of the slide control processing procedure and example of the slide operation of the movable support parts 104 which are executed by the control unit 64, respectively, will be described. FIG. 16 is the flow chart for illustrating the example of the slide control processing procedure. FIG. 17 to FIG. 19 are the schematic views for illustrating the slide operation of the movable support parts 104. S1, S2 in the figures represent processing procedure (step) numbers. The processing starts from a step S1.

In the compound machine 1, the user performs setting of enabling a borderless recording function with the operation panel 4 in advance. Then, after inputting of an instruction to start image recording, processing after the step S1 is started. When determination is made that borderless recording is not set, that is, normal image recording is performed, image recording is performed in the state where the movable support parts 104 are stationary at a reference position set around the center of the groove 116.

On the other hand, when determination is made that the borderless recording function is set, first, the movable support parts 104 are moved to the reference position. The sensor 124 (refer to FIG. 8) is provided at one end on the side of the main scanning direction of the movable support parts 104. A photo interrupter not shown for detecting the sensor 124 is provided at a guide member on the sheet conveyance path 23. The sensor 124 and the photo interrupter are located at the position where the sensor 124 can be detected by the photo interrupter when the movable support parts 104 are moved to the reference position. Thus, by driving the rib motor 93 while monitoring a detection signal sent from the photo interrupter, movement of the movable support parts 104 to the reference position is achieved.

When the movable support parts 104 are moved to the reference position, at the step S1, the movable support parts 104 are slid to the position T1 shown in FIG. 17. The position T1 is a predetermined position between adjacent first fixing ribs 102. In this processing, specifically, as described above, in response to the instruction of the CPU 65, the ASIC 70 generates the phase excitation signal for passing the electric current to the rib motor 93. Then, the electric signal generated by the drive circuit 94 in response to the output signal of the ASIC 70 is sent to the rib motor 93, thereby sliding the movable support parts 104. The instruction of the CPU 65 contains the number of steps which is required to slide the movable support parts 104 from the reference position (around the center of the groove 116) to the position T1 as positional information. Based on the number of steps, the rib motor 93 is rotationally driven. Since the below-mentioned sliding of the movable support parts 104 to the positions T2, T3, T4 is performed according to the same control procedure as that in the sliding to the position T1, the slide processing procedure to each position will be omitted in the following description.

In this embodiment, the movable support parts 104 are slid from the reference position to the position T1 prior to the below-mentioned feeding of the recording sheet. However, the movable support parts 104 may be moved to the image recording position to the position T1 before the recording sheet reaches to the position on the platen 42. Alternatively, even after the recording sheet reaches to the image recording position, the movable support parts 104 may be moved to the position T1 before image recording on the recording sheet is performed.

Figure 17A:
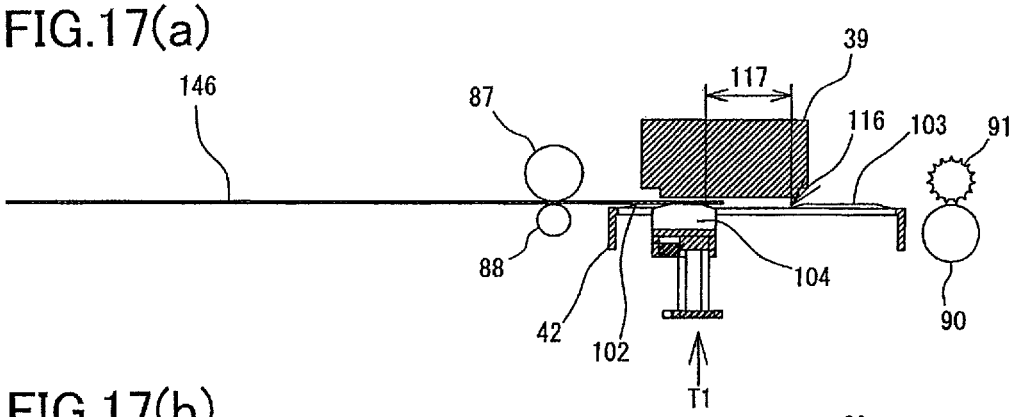
FIG. 17 is a schematic view showing relationship between conveyance of a recording sheet 146 and movement of a movable support part 104 in the compound machine 1 in accordance with the first embodiment of the present invention.

When the movable support parts 104 are slid to the position T1, at a step S2, the recording sheet 146 accommodated in the sheet feed tray 20 (refer to FIG. 17) is conveyed toward the platen 42. Describing in detail, first, by controlling driving of the LF motor 71 by the control unit 64 to rotate the sheet feed tray 25, a uppermost recording sheet 146 in the sheet feed tray 20 is sent to the sheet conveyance path 23. When the recording sheet 146 reaches the pair of conveyance rollers 89, a resist operation is performed. By the resist operation, the front end of the recording sheet 146 is adjusted to correct inclination of the recording sheet 146. Specifically, advance of the recording sheet 146 is inhibited by the pair of conveyance rollers 89 rotated by the LF motor 71 in the direction of returning the recording sheet 146 upstream in the conveyance direction (reverse rotation). The resist operation is continued until a predetermined time period has elapsed since the front end of the recording sheet 146 is detected by the regi-sensor 95. When the resist operation is finished, the pair of conveyance rollers 89 rotates in the direction of conveying the recording sheet 146 downstream in the conveyance direction (normal rotation). At this time, the front end of the recording sheet 146 is conveyed by the pair of conveyance rollers 89 to the position where the image is recorded by the image recording unit 24 (specifically, the ink jet recording head 39) (image recording position). That is, head-finding conveyance of the recording sheet 146 is performed. The head-finding conveyance is performed by controlling driving of the LF motor 71 on the basis of the number of steps corresponding to the distance between the resist position where the resist operation is performed and the image recording position. By the head-finding conveyance, the front end of the recording sheet 146 is conveyed to the position at which the recording sheet 146 protrudes on the groove 116 by the width p1 and is made stationary in this state. When the recording sheet 146 is conveyed to the image recording position, as shown in FIG. 17A, the front end of the recording sheet 146 is supported by the first fixing ribs 102 and the movable ribs 121. At this time, the movable ribs 121 are completely covered with the recording sheet 146 in a plan view.

When head-finding conveyance of the recording sheet 146 is performed, at a step S3, image recording on a region for one line feed is performed. That is, the scanning carriage 38 is slidingly reciprocated once in the main scanning direction while ink drops are selectively ejected from the ink jet recording head 39. Since the movable ribs 121 is completely covered with the recording sheet 146 in a plan view, even when the ink drops are blown to the front end of the recording sheet 146, the movable ribs 121 are not smeared with ink.

Subsequently, at a step S4, it is determined whether or not the front end of the recording sheet 146 is located at the position where image recording is performed. Specifically, it is determined whether or not the front end of the recording sheet 146 falls within a range between the image recording position and the downstream end of the frame 100 in the conveyance direction (hereinafter referred to as an "end printing range"). Such determination is made, for example, by allowing the CPU 64 to monitor the number of steps of the LF motor 71 from the resist position or the number of steps of the LF motor 71 after head-finding conveyance and calculating the conveyance position of the recording sheet 146 from the number of steps. As a matter of course, a determination method is not limited to the above-mentioned method and determination may be made by detecting the conveyance position of the recording sheet 146 using a plurality of optical sensors. The above-mentioned end printing range is merely an example. The range may be appropriately set and, for example, a range where the front end of the recording sheet 146 is located on the groove 116.

When it is determined that the front end of the recording sheet 146 falls within the end printing range at the step S4, the movable support parts 104 are slid at the timing (slide start timing) according to the conveyance position of the front end of the recording sheet 146. Specifically, first, the recording sheet 146 is intermittently conveyed by one line feed (S5) and then, the movable support parts 104 are slid downstream in the conveyance direction by one line feed (S6). That is, sliding of the movable support parts 104 is performed at a timing later than conveyance of the recording sheet 146. At this time, the movable support parts 104 are slid in the state where the front ends of the movable ribs 121 in the conveyance direction are shifted upstream from the front end of the recording sheet 146 in the conveyance direction by the width p1. As a result, the movable ribs 121 are covered with the recording sheet 146 at all times.

Here, intermittent conveyance of the recording sheet 146 is achieved by controlling driving of the LF motor 71 by the control unit 64 on the basis of the number of steps corresponding to one line feed width. Sliding of the movable support parts 104 is also achieved by controlling driving of the rib motor 93 by the control unit 64 on the basis of the number of steps corresponding to one line feed width. In this embodiment, when it is determined that the front end of the recording sheet 146 falls within the end printing range at the step S4, as described above, first, the recording sheet 146 is conveyed and then, the movable support parts 104 are slid. Thus, the problem does not occur that undried ink ejected to the front end of the recording sheet 146 is adhered to the movable ribs 121. Furthermore, the back surface of the recording sheet 146 is not smeared with ink.

In this embodiment, the movable support parts 104 are slid after intermittent conveyance of the recording sheet 146 is finished. However, intermittent conveyance of the recording sheet 146 needs only to be started ahead of the sliding. Thus, sliding of the movable support parts 104 may be started during intermittent conveyance of the recording sheet 146. In this case, for example, it is necessary to assure that the movable ribs 121 slid later may not pass the conveyance position of the front end of the recording sheet 146 by setting the conveyance speed of the recording sheet 146 and the moving speed of the movable ribs 121 to the same speed. Intermittent conveyance of the recording sheet 146 and sliding of the movable support parts 104 may be started simultaneously by bringing the operations in sync with each other. In either case, the problem does not occur that ink is adhered to the movable ribs 121 and smears the movable ribs 121.

Figure 17B:
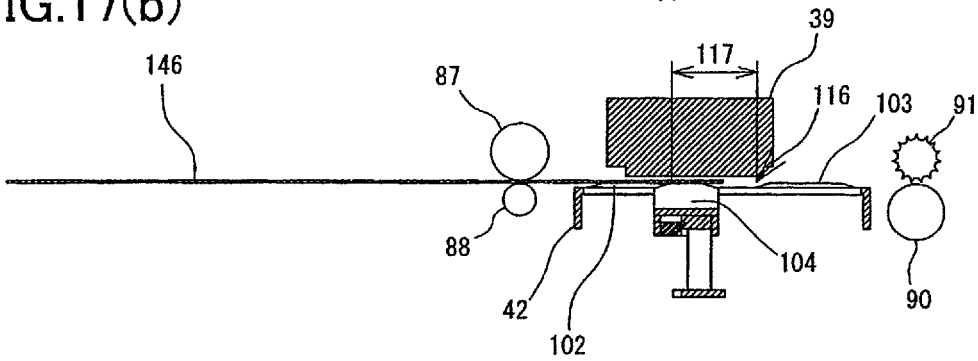
Figure 17C:
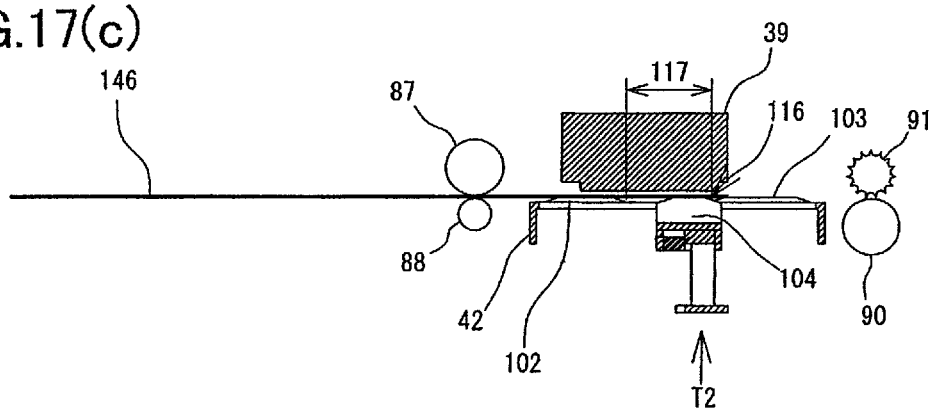

When movement of the movable support parts 104 is finished, at a step S7, it is determined whether or not image recording for 1 page is finished. Such determination can be made, for example, by allowing the CPU 64 to monitor the number of steps of the LF motor 71 or the number of times of scanning of the carriage 38 and determining whether or not the monitored value reaches a predetermined value. Here, when it is determined that image recording for 1 page is finished (Yes at S7), the recording sheet 146 on which the image is recorded is discharged to the sheet discharge tray 21. On the other hand, when it is determined that image recording for 1 page is not finished (No at S7), the processing at the step S3 and the subsequent steps is repeated. By repeating conveyance of the recording sheet 146 (S5) and sliding of the movable support parts 104 (S6) by repeating processing at the step S3 to the step S6 in this manner, the movable support parts 104 are slid from the position T1 shown in FIG. 17A so as to follow conveyance of the recording sheet 146 as shown in FIGS. 17B and 17C. Sliding of the movable support parts 104 at this time is stopped at the point when the movable support parts 104 reaches the position T2 where the downstream ends of the movable ribs 121 in the conveyance direction substantially coincide with the ends of the second fixing ribs 103 on the side of the groove 116. At the position T2, the movable support parts 104 remain at rest for a while. The position T2 may be any position as long as the recording sheet 146 can be guided to the second fixing ribs 103 without hanging-down of the front end of the recording sheet 146 toward the groove 116 and damage of the front end. Thus, a gap of the width p1 between the movable ribs 121 and the second fixing ribs 103 causes no problem.

Figure 18A:
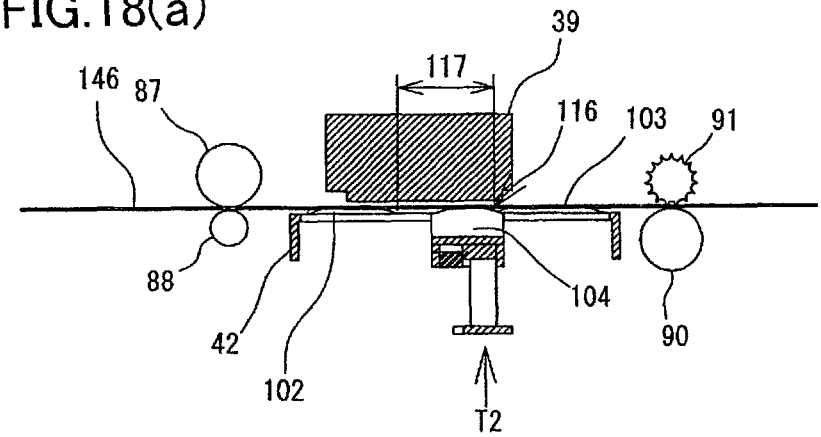
FIG. 18 is a schematic view showing relationship between conveyance of the recording sheet 146 and movement of the movable support part 104 in the compound machine 1 in accordance with the first embodiment of the present invention.

When the recording sheet 146 is further conveyed, for example, as shown in FIG. 18A, it is determined that the front end of the recording sheet 146 does not fall within the end printing range at the step S4 (No at S4). Such determination can be easily made by grasping the conveyance position of the recording sheet 146 on the basis of the number of steps monitored by the CPU64. When it is determined as described above, the procedure proceeds to a step S9. At the step S9, it is determined whether or not the rear end of the recording sheet 146 is located at the position where image recording is performed. Specifically, it is determined whether or not the rear end of the recording sheet 146 is located in the end printing range. Such determination is made by calculating the conveyance position of the recording sheet 146 on the basis of the number of steps of the LF motor 71 from the resist position or the number of steps of the LF motor 71 after head-finding conveyance. Here, when determination is made that the rear end of the recording sheet 146 is not located in the end printing range (No at S9), the procedure proceeds to a step S12.

At the step S12, it is determined whether or not the conveyance position of the recording sheet 146 is a center record position. Here, the center record position is a conveyance position of the recording sheet 146 where image recording is performed in the state where the recording sheet 146 is conveyed while being held between both the pair of conveyance rollers 89 and the pair of sheet discharge rollers 92. The determination at the step S12 is also made by calculating the conveyance position of the recording sheet 146 on the basis of the number of steps of the LF motor 71 from the resist position or the number of steps of the LF motor 71 after head-finding conveyance. Needless to say, the determination is made on the basis of detection signals of the regi-sensor 95 and a sensor not shown which is provided downstream of the pair of sheet discharge rollers 92.

Figure 18B:
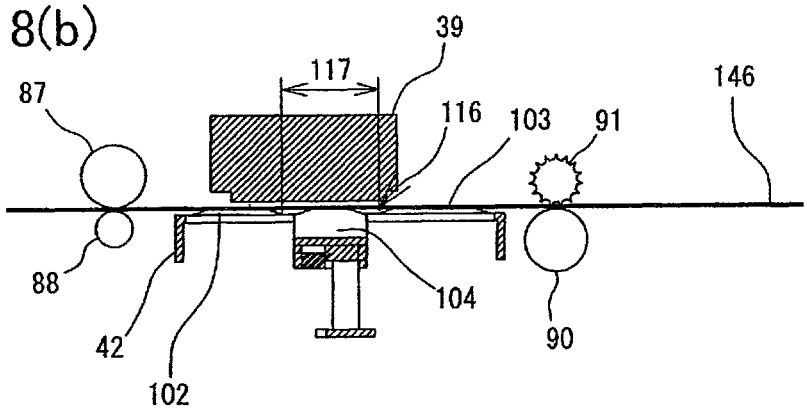
Figure 18C:
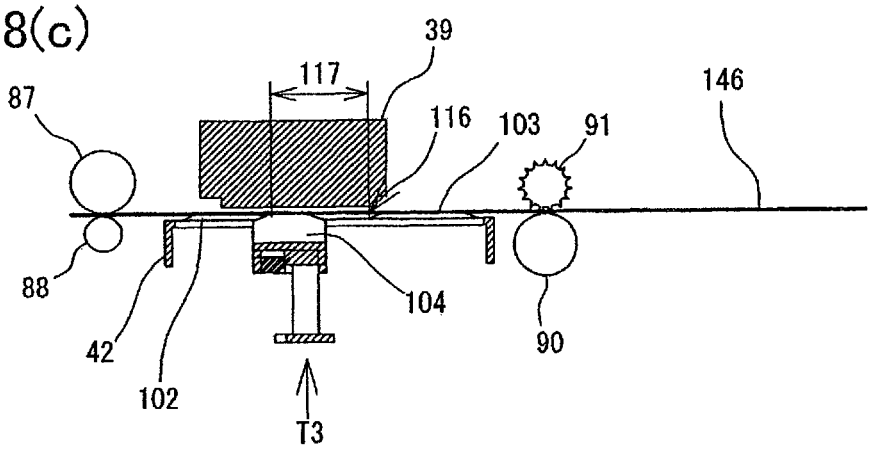

When the recording sheet 146 is further conveyed, the front end of the recording sheet 146 escapes from the end printing range and then determination is made that the conveyance position of the recording sheet 146 is the center record position at the step S12 (Yes at S12), it is determined whether or not the movable support parts 104 are located at the position T3 shown in FIG. 18C at a step S13. Here, the position T3 is a position where the upstream ends of the movable ribs 121 in the conveyance direction substantially coincide with the ends of the first fixing ribs 103 on the side of the groove 116. At the present time, since the movable support parts 104 are rest at the position T2 shown in FIG. 17C, the movable support parts 104 are not located at the position T3. The position T3 may be any position as long as the end of the recording sheet 146 can be guided from the first fixing ribs 102 to the movable ribs 121 without hanging-down of the end (the front end or the rear end) of the recording sheet 146 toward the groove 116 and damage of the end. Thus, a gap of the width p1 between the movable ribs 121 and the first fixing ribs 102 causes no problem.

When it is determined that the movable support parts 104 are not located at the position T3 at the step S13 (No at S13), the movable support parts 104 are slid to the position T3 at a next step S14 (refer to FIG. 18C). That is, the movable support parts 104 are slid from the position T2 shown in FIG. 18A in the direction opposite to the conveyance direction of the recording sheet 146 as shown in FIGS. 18B and 18C, that is, from the position T2 to the upstream side in the conveyance direction. Then, after sliding in the reverse direction, the recording sheet 146 on which the image is recorded is intermittently conveyed downstream in the conveyance direction (S15). After that, the procedure proceeds to the step S7.

On the other hand, when it is determined that the movable support parts 104 are located at the position T3 at the step S13 (Yes at S13), sliding of the movable support parts 104 in the reverse direction is stopped and only intermittent conveyance of the recording sheet 146 is performed (S15).

When it is determined that the conveyance position of the recording sheet 146 is not the center record position at the step S12, that is, recording sheet 146 are not held by both the pair of conveyance rollers 89 and the pair of sheet discharge rollers 92, the movable support parts 104 are not slid in the direction opposite to the conveyance direction and the recording sheet 146 on which the image is recorded is intermittently conveyed downstream in the conveyance direction (S15). As described above, in this embodiment, only when the recording sheet 146 is conveyed while being held by both the pair of conveyance rollers 89 and the pair of sheet discharge rollers 92, that is, the recording sheet 146 is in a stable state without being pulled due to the frictional force with the movable ribs 121, the movable support parts 104 are slid in the reverse direction. Thus, bending of the recording sheet 146 is prevented, thereby achieving satisfactory image recording.

When the recording sheet 146 is conveyed while being held only by the pair of sheet discharge rollers 92, the movable support parts 104 may be slid in the reverse direction. This is due to that even when the recording sheet 146 is pulled and bent once by sliding of the movable support parts 104 in the reverse direction, the bending is removed by subsequent intermittent conveyance of the recording sheet 146.

Figure 19A:
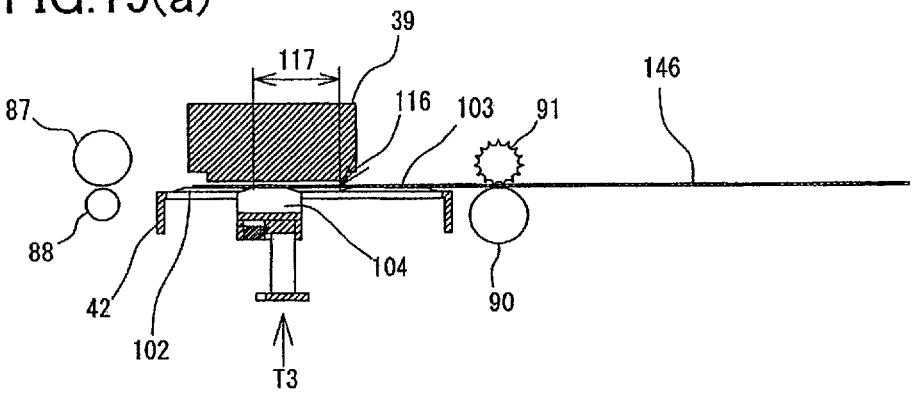
FIG. 19 is a schematic view showing relationship between conveyance of the recording sheet 146 and movement of the movable support part 104 in the compound machine 1 in accordance with the first embodiment of the present invention.
Figure 19B:
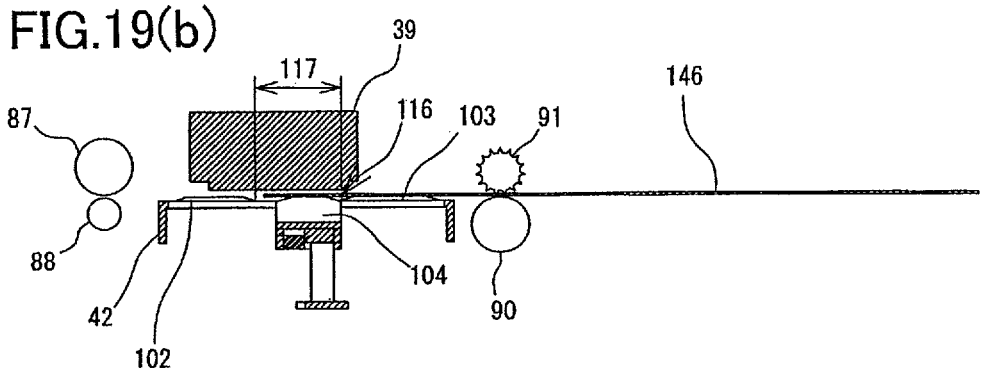
Figure 19C:
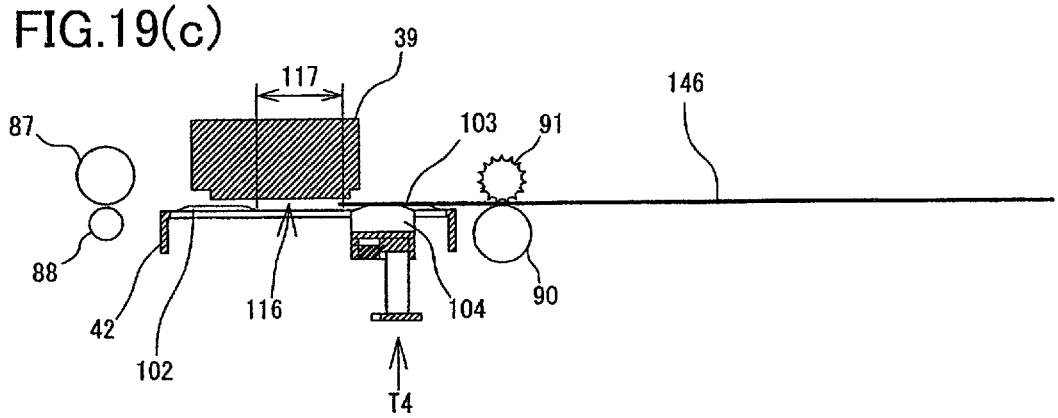

When the recording sheet 146 is further conveyed as shown in FIG. 19A, determination is made that the rear end of the recording sheet 146 is located in the end printing range at the step S9 (Yes at S9). Such determination can be easily made by grasping the conveyance position of the recording sheet 146 on the basis of the number of steps monitored by the CPU 64. When it is determined as described above, the movable support parts 104 are slid at a timing (slide start timing) according to the conveyance position of the rear end of the recording sheet 146. Specifically, first, the movable support parts 104 are slid downstream in the conveyance direction by one line feed at the step S10. Then, the recording sheet 146 is intermittently conveyed by one line feed (S11). At this time, the movable support parts 104 are slid in the state where the rear ends of the movable ribs 121 in the conveyance direction are shifted downstream from the rear end of the recording sheet 146 in the conveyance direction by at least the width p1 (corresponding to the predetermined width). Thus, the movable ribs 121 are covered with the recording sheet 146 at all times. When the recording sheet 146 is intermittently conveyed by one line feed, the procedure proceeds to the step S7. That is, sliding of the movable support parts 104 is performed at an earlier timing of conveyance of the recording sheet 146. Accordingly, in this case, the recording sheet 146 is conveyed so as to follow sliding of the movable support parts 104. In this embodiment, after the image is recorded on the rear end of the recording sheet 146, the movable support parts 104 are, as shown in FIG. 19, slid to the position T4 downstream of the position T2 in the conveyance direction. The position T4 is a predetermined position between the adjacent second fixing ribs 102.

In this embodiment, as described in the case at the steps S10 and S11, after the movable support parts 104 are slid by the predetermined width, the recording sheet 146 is intermittently conveyed. However, for example, when the conveyance speed of the recording sheet 146 and the moving speed of the movable ribs 121 are the same speed or the rear end of the recording sheet 146 cannot catch the movable ribs 121, sliding of the movable support parts 141 needs only to be started ahead of the intermittent conveyance. Thus, intermittent conveyance of the recording sheet 146 may be started during sliding of the movable support parts 104. Sliding of the movable support parts 104 and intermittent conveyance of the recording sheet 146 may be started simultaneously by bringing the operations in sync with each other. In either case, the problem does not occur that ink is adhered to the movable ribs 121 and smears the movable ribs 121.

As described above, in this embodiment, when it is determined that the rear end of the recording sheet 146 is located in the end printing range at the step S9, as described above, first, the movable support parts 104 are slid and then, the recording sheet 146 is conveyed. Thus, immediately after recording, the rear end of the recording sheet 146 does not move on the movable ribs 121. Accordingly, the problem does not occur that undried ink ejected to the rear end of the recording sheet 146 is adhered to the movable ribs 121 and the back surface of the recording sheet 146 is not smeared with the ink. In this embodiment, the movable support parts 104 are slid in the state where the rear ends of the movable ribs 121 in the conveyance direction are shifted downstream in the conveyance direction from the rear end of the recording sheet 146 in the conveyance direction by the width p1 (corresponding to the predetermined width). Thus, since the movable ribs 121 are covered with the recording sheet 146 at all times, ink is not adhered to the movable ribs 121.

In this embodiment, when borderless recording is performed, image recording on the end of the recording sheet becomes possible while ink drops are ejected from all nozzles of the recording head 39. That is, borderless recording is performed at high speed and complicated control in relation to ejection of ink drops from an ink ejection port 53 becomes unnecessary. Furthermore, the cross section of the ink ejection port 53 is not necessarily a perfect circle. Minute dusts may be adhered to inner surface of the ink ejection port 53. Accordingly, ink drops may be ejected in a slight oblique direction, not directly below the ink ejection port 53. In this case, since the width W of the groove 116 is set to be larger than the ink ejection region 118 of the recording head 39, the ink drops are not adhered to the outside of the groove 116. As a result, it is possible to reliably prevent the back surface of the recording medium from being smeared with ink. (Effect of B0105)

Figure 20:
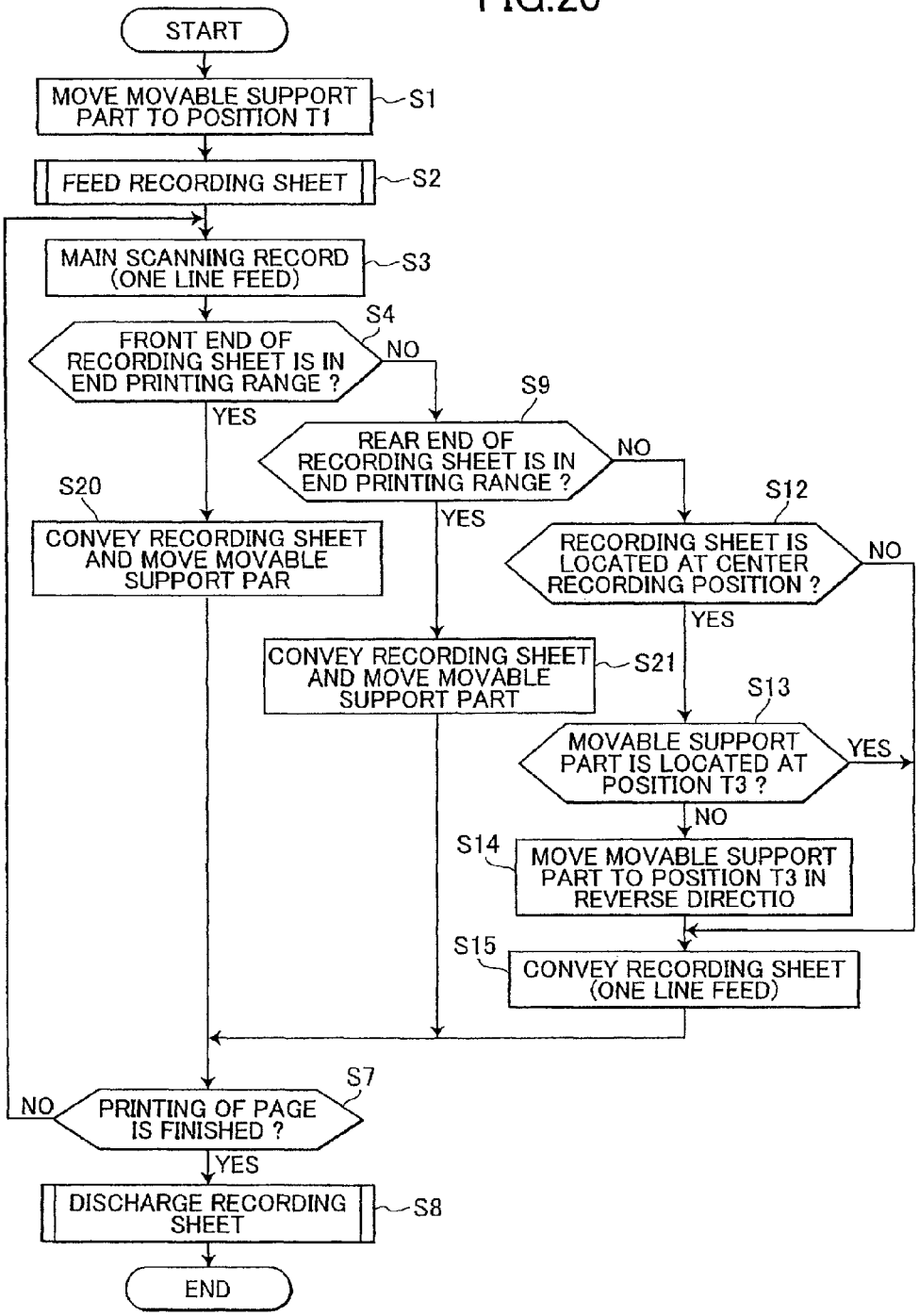
FIG. 20 is a flow chart for illustrating an example of procedure of slide control processing executed by the control unit 64 in accordance with a second embodiment of the present invention.

Next, a second embodiment of the present invention will be described with reference to FIG. 20 to FIG. 22. In the second embodiment, description of elements which are same as those in the first embodiment is omitted.

Referring to a flow chart of FIG. 20 and schematic views of FIG. 21 to FIG. 22, an example of slide control processing procedure and an example of a slide operation of movable support parts 104 in accordance with the second embodiment, respectively, will be described. FIG. 20 is the flow chart for illustrating the example of the slide control processing procedure in the second embodiment. FIG. 21 to FIG. 22 are the schematic views for illustrating the slide operation of the movable support parts 104.

In the second embodiment (FIG. 20), processing at a step 20 is performed in place of the processing at the step S5 and the step S6 in the first embodiment (FIG. 16) and processing at a step S21 is performed in place of the processing at the step S10 and the step S11 in the first embodiment. Here, only the step S20 and the step S11 are described and description of the other steps is omitted.

By the head-finding conveyance performed at the step S2, as described above, the front end of the recording sheet 146 overhangs from the movable ribs 104 by the distance p1 and the use region 99 of the ink jet recording head 39 overhangs from the front end of the recording sheet 146 in the conveyance direction by the distance f (refer to FIG. 18). When the main scanning recording for one line feed is performed, the procedure proceeds to the step S4.

Figure 21A:
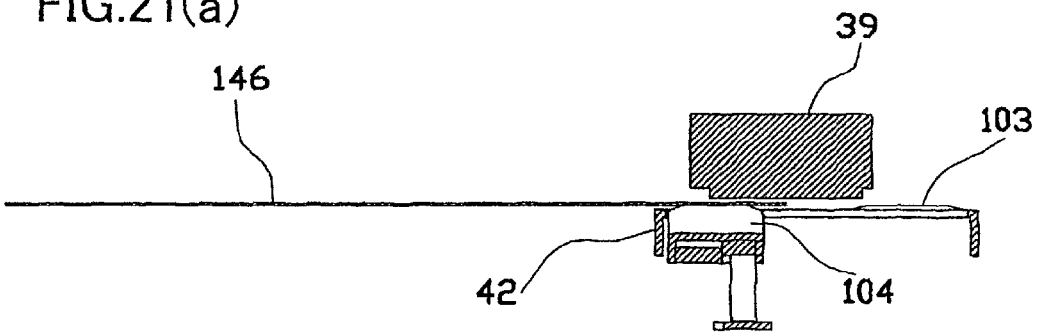
FIG. 21 is a schematic view showing relationship between conveyance of the recording sheet 146 and movement of the movable support part 104 in the compound machine 1 in accordance with the second embodiment of the present invention.
Figure 21B:
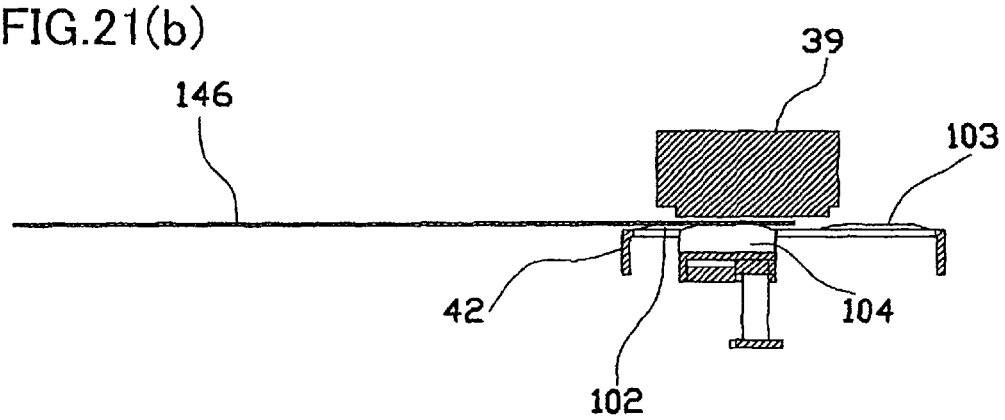
Figure 21C:
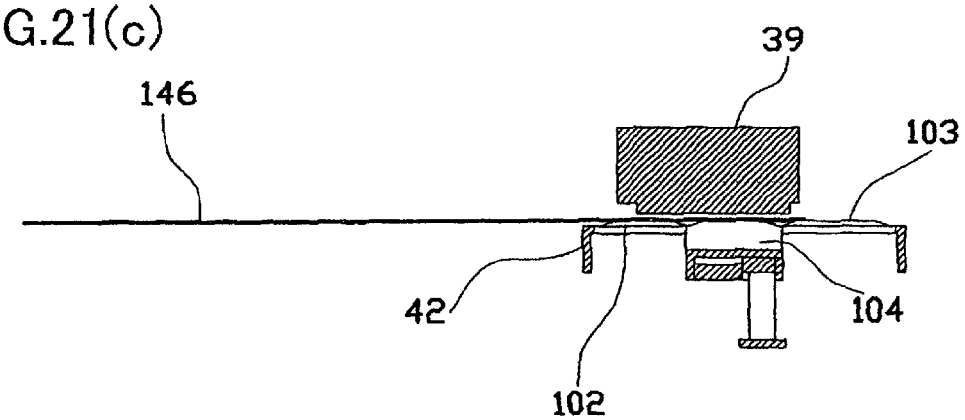

In this embodiment, when the front end of the recording sheet 146 is in the end printing range (Yes at S4), the procedure proceeds to the step S20. At the step S20, conveyance of the recording sheet 146 and movement of the movable ribs 104 are performed simultaneously. Specifically, as shown in FIGS. 21A and 21B, the movable ribs 104 are slid downstream in the conveyance direction following conveyance of the recording sheet 146 while supporting the front end of the recording sheet 146. That is, the movable ribs 104 follows the recording sheet 146 as the overhang distances f and p1 are maintained. At this time, since the area where the recording sheet 146 covers the platen 42 becomes larger as the recording sheet 146 is conveyed, the use region 99 of the ink jet recording head 39 also becomes larger with conveyance of the recording sheet 146. As shown in FIG. 21C, the movable ribs 104 returns to the initial position T3 (the center of the groove 116) and the use region 99 of the ink jet recording head 39 becomes maximum. As in the first embodiment, the procedure proceeds to the step S7.

When the recording sheet 146 is further conveyed, at the step S4 and it is determined that the front end of the recording sheet 146 is not located in the recording range (No at S4), the procedure proceeds to the step S9. When determination is made that the rear end of the recording sheet 146 is located in the end printing range at the step S9 (Yes at S9), the procedure proceeds to the step S21.

Figure 22A:
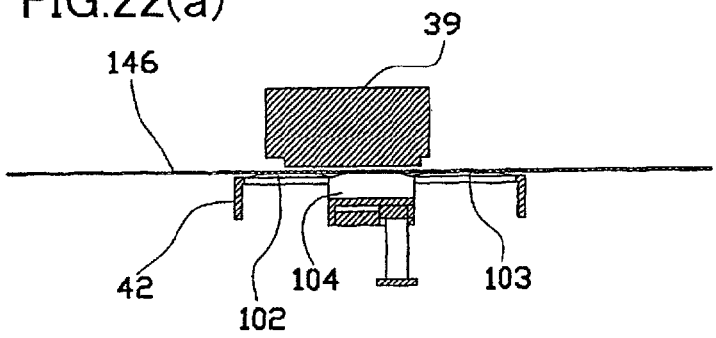
FIG. 22 is a schematic view showing relationship between conveyance of the recording sheet 146 and movement of the movable support part 104 in the compound machine 1 in accordance with the second embodiment of the present invention.
Figure 22B:
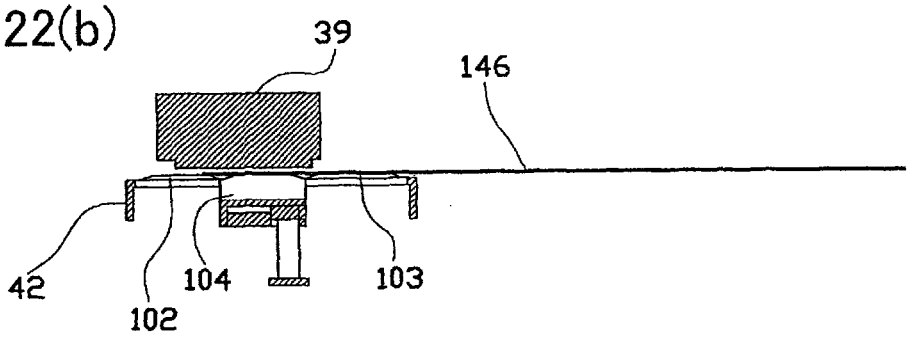

At the step S21, the movable ribs 104 follow the recording sheet 146 again and moves in the conveyance direction. Specifically, when the rear end of the recording sheet 146 passes the regi-sensor 95 (refer to FIG. 3), the control unit 64 grasps that the rear end passes the regi-sensor 95 on the basis of a signal output from the regi-sensor 95 (FIG. 22A). On the basis of encoder quantity detected by the rotary encoder 76, position of the rear end of the recording sheet 146 is grasped by the control unit 64. When the rear end of the recording sheet 146 gets closer to the movable ribs 104 and overhangs upstream in the conveyance direction from the movable ribs 104 by the distance p2 and the use region 99 of the ink jet recording head 39 overhangs upstream in the conveyance direction from the rear end of the recording sheet 146 by the distance f, the movable ribs 104 which stops at the initial position are slid in the conveyance direction.

Figure 22C:
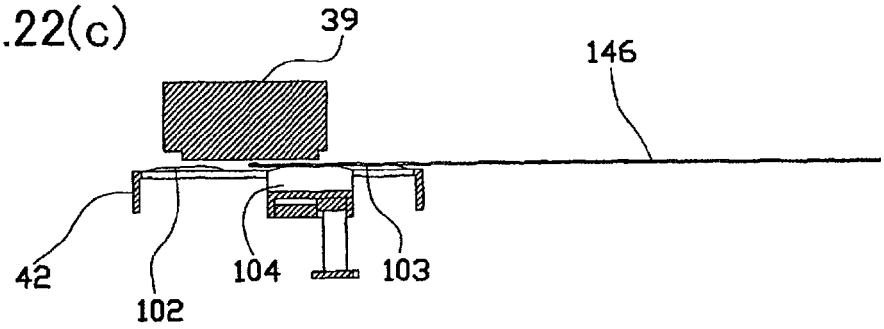
Figure 22D:
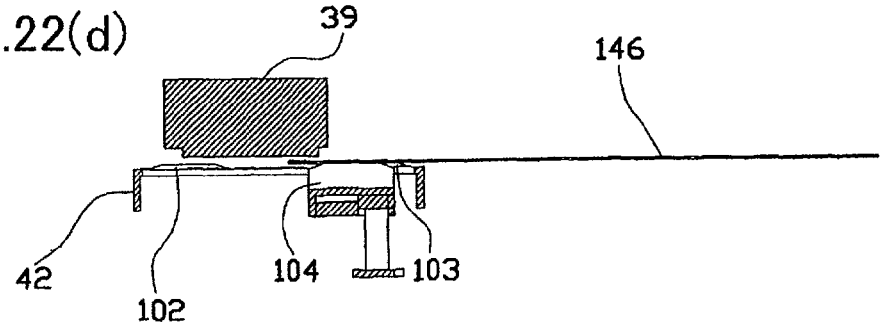

As shown in FIG. 22C, the movable ribs 104 are slid downstream in the conveyance direction following the recording sheet 146 while supporting the rear end of the recording sheet 146. Specifically, the rib motor 93 is driven by the control unit 64, thereby rotating a rotational plate 125 to the right in FIG. 12. Then, the movable ribs 104 reach the position shown in FIG. 22D and stops. At this time, as described above, the rear end of the recording sheet 146 overhangs from the movable ribs 104 by the distance p2 and the use region 99 of the ink jet recording head 39 overhangs from the front end of the recording sheet 146 in the conveyance direction by the distance f.

In the compound machine 1 in accordance with this embodiment, especially when borderless recording is performed, the above-mentioned overhang distance f is set. Thus, the ink drops ejected from the ink jet recording head 39 are reliably ejected to the border of the recording sheet 146, thereby preventing defective recording such as so-called printing in white. When the recording sheet 146 is conveyed on the platen 42, the movable ribs 104 are slid while supporting the recording sheet 146. Thus, the front end and the rear end of the recording sheet 146 are supported at all times. Consequently, even when the recording sheet 146 is plain paper or the other high visible paper, the recording sheet 146 never hangs down and the distance between the recording sheet 146 and the ink jet recording head 39 is kept constant. As a result, high-image quality borderless printing is achieved.

Since the length R of the movable ribs 104 in the conveyance direction is set as described above, even when the movable ribs 104 axe stopped in the center of the platen 42 during conveyance of the recording sheet 146, the front end and the rear end of the conveyed recording sheet 146 do not hang down. That is, by setting the length R of the movable ribs 104 as described above, the movable ribs 104 are designed to have necessary and sufficient size. Thus, the movable ribs 104 need not be slid in the direction opposite to the conveyance direction during printing to prevent hanging-down of the end of the recording sheet 146 and support the recording sheet 146. Consequently, the compound machine 1 can be made compact and the motion of the movable ribs 104 in image recording is simplified. As a result, control of the movable ribs 104 by the control unit 64 is simplified and electric power for driving the movable ribs 104 is reduced.

In addition, since the conveyed recording sheet 146 is supported by the movable ribs 104, the width dimension W of the groove 116 provided on the platen 42 can be set large. Thus, the use region 99 of the ink jet recording head 39 is set large, thereby enabling high-speed recording. In this embodiment, since the distance E1 obtained by adding the overhang distance f to the overhang distance p1 and the distance E2 obtained by adding the overhang distance f to the overhang distance p2 are each set to 1 mm to 13 mm, even when the recording sheet 146 is any of plain water, photo L-size paper or the other various recording media, hanging-down of the recording sheet 146 is prevented. Thus, irrespective of the type of the recording medium, satisfactory borderless recording is advantageously performed.

In this embodiment, since the width dimension W in the conveyance direction of the groove 116 provided on the platen 42 is set so as to satisfy W>R+E1+E2, even when the use region 99 of the ink jet recording head 39 varies in any way during borderless recording, ink drops ejected beyond the border of the recording sheet 146 are reliably received in the groove 116. Thus, it is possible to reliably prevent the platen 42 and the recording sheet 146 from being smeared with the ink drops ejected from the ink jet recording head 39.

In this embodiment, since the conveyed recording sheet 146 is supported by the first fixing ribs 102, the second fixing ribs 103 and the movable ribs 104, a contact area between the recording sheet 146 and each of the ribs 102 to 104 becomes smaller and thus, smooth conveyance of the recording sheet 146 is achieved. Moreover, since configuration of the first fixing ribs 102, the second fixing ribs 103 and the movable ribs 104 becomes extremely simple, increase in manufacturing costs of the compound machine 1 is advantageously suppressed.

While the invention has been described in detail with reference to the specific embodiment thereof, it would be apparent to those skilled in the art that various changes and modifications may be made therein without departing from the spirit of the invention. For example, the drive source for the movable ribs 104 is not specifically limited. The movable ribs 104 may be driven by the CR motor 73 as a drive source. Specifically, the movable ribs 104 may be driven by power which is generated by the carriage 38 slid by CR motor 73 and transmitted through the drive mechanism.

The above-mentioned embodiments are merely examples of the present invention. Thus, as, a matter of course, the embodiments may be modified as necessary so as not to change the subject matter of present invention. For example, unlike the above-mentioned embodiments, a drive mechanism described in Japanese Patent Application Publication No. 2006-326990, which are previously filed by this Applicant, may be adopted as the drive mechanism.

What is claimed is:

1. An ink jet recording device comprising:

a recording head configured to eject ink droplets onto a recording medium;

a conveying member configured to convey the recording medium in a conveying direction, the recording medium having a leading edge and a trailing edge in the conveying direction;

a platen disposed in confrontation with the recording head to support the recording medium while keeping a predetermined distance from the recording head;

a supporting member disposed in the platen to slide in the conveying direction while supporting the recording medium; and a driving member configured to drive the supporting member to start sliding in the conveying direction at a starting timing corresponding to a position of at least one of the leading edge and the trailing edge, wherein the supporting member has a length (R) in the conveying direction, and the length (R) satisfies the equation R=H−(E1+E2), in which:

H: a length of a maximum printing region of the recording head in the conveying direction;

E1: p1+f;

E2: p2+f;

p1: a length by which the recording medium overhangs the supporting member in the conveying direction when a borderless recording is performed for a leading edge area of the recording medium;

p2: a length by which the recording medium overhangs the supporting member in a direction opposite to the conveying direction when a borderless recording is performed for a trailing edge area of the recording medium; and f: a length by which an ejecting region of the recording head that actually ejects ink droplets overhangs the recording medium in the conveying direction when the borderless recording is performed for the leading edge area of the recording medium and in a direction opposite to the conveying direction when the borderless recording is performed for the trailing edge area of the recording medium.

2. The ink jet recording device according to claim 1, wherein the driving member drives the supporting member to start sliding after the leading edge of the recording medium starts sliding in a first predetermined region.

3. The ink jet recording device according to claim 1, wherein the driving member drives the supporting member to start sliding before the trailing edge of the recording medium starts sliding in a second predetermined region.

4. The ink jet recording device according to claim 1, wherein the driving member drives the supporting member to slide in synchronization with movement of the recording medium.

5. The ink jet recording device according to claim 1, wherein the supporting member has a chamfered corner at a position where the leading edge of the recording medium is abutable in the conveying direction.

6. The ink jet recording device according to claim 1, wherein E1 and E2 are each set to 1 mm to 13 mm.

7. The ink jet recording device according to claim 1, wherein the platen includes a first supporting part and a second supporting part, each being disposed in confrontation with the recording head, the second supporting part being disposed at a downstream of the first supporting part in the conveying direction and opposed to the first supporting part in the conveying direction, a groove extending in a main scanning direction orthogonal to the conveying direction being formed between the first supporting part and the second supporting part, the groove having a printing region over which the recording head can eject ink droplets, the groove having a groove width W in the conveying direction, wherein the groove length (W) meets the following inequation:

$$W>R+E1+E2.$$

8. The ink jet recording device according to claim 7, wherein the driving member drives the supporting member to move to a position that overhangs the recording medium in the conveying direction by p1 for supporting the recording medium when the leading edge of the recording medium reaches a first position at an upstream of the printing region in the conveying direction.

9. The ink jet recording device according to claim 8, wherein the driving member drives the supporting member to stop when the leading edge reaches the length of the maximum printing region of the recording head in the conveying direction (H).

10. The ink jet recording device according to claim 9, wherein the driving member drives the supporting member to move to a position that overhangs the recording medium in the direction opposite to the conveying direction by p2 for supporting the recording medium when the trailing edge of the recording medium reaches a second position positioned at an upstream of the printing region in the conveying direction.

11. The ink jet recording device according to claim 1, wherein the supporting member has a leading end and a trailing end in the conveying direction, and therefore the recording medium has a leading region including the leading end and a trailing region including the trailing end in the conveying direction, and wherein the driving member slides the supporting member to a position that is apart from the leading end toward an upstream of the leading end in the conveying direction a predetermined distance when the recording head performs a borderless recording for the leading region and to a position that is apart from the trailing end toward a downstream of the trailing end in the conveying direction a predetermined distance when the recording head performs the borderless recording for the trailing region.

* * * * *